US010890068B2

(12) United States Patent
McKenzie

(10) Patent No.: US 10,890,068 B2
(45) Date of Patent: Jan. 12, 2021

(54) AUTOMATED SUPPORT OF A GATE ENTRY FOR UNDERGROUND FULL EXTRACTION MINING

(71) Applicant: Jefferson David McKenzie, Magna, UT (US)

(72) Inventor: Jefferson David McKenzie, Magna, UT (US)

( * ) Notice: Subject to any disclaimer, the term of this patent is extended or adjusted under 35 U.S.C. 154(b) by 0 days.

(21) Appl. No.: 16/713,721

(22) Filed: Dec. 13, 2019

(65) Prior Publication Data

US 2020/0190982 A1 Jun. 18, 2020

Related U.S. Application Data

(60) Provisional application No. 62/780,255, filed on Dec. 15, 2018.

(51) Int. Cl.

| | |
|---|---|
| ***E21D 23/14*** | (2006.01) |
| ***E21D 23/26*** | (2006.01) |
| ***E21D 23/00*** | (2006.01) |
| ***E21C 27/02*** | (2006.01) |

(52) U.S. Cl.

CPC ..... *E21D 23/14* (2013.01); *E21C 27/02* (2013.01); *E21D 23/0034* (2013.01); *E21D 23/26* (2013.01)

(58) Field of Classification Search

CPC ... E21D 23/14; E21D 23/142; E21D 23/0091; E21D 23/0065; E21D 23/0073; E21D 23/0086

See application file for complete search history.

(56) References Cited

U.S. PATENT DOCUMENTS

| | | | |
|---|---|---|---|
| 3,903,703 | A | 9/1975 | Lubojatsky |
| 4,065,929 | A | 1/1978 | Simpson |
| 4,079,792 | A | 3/1978 | Paul et al. |
| 4,217,067 | A | 8/1980 | Lagodka et al. |
| 4,372,618 | A | 2/1983 | Pearey |
| 4,465,406 | A | 8/1984 | Beckmann |

(Continued)

FOREIGN PATENT DOCUMENTS

| | | | |
|---|---|---|---|
| EP | 0150210 | A1 | 8/1985 |
| EP | 0150210 | B1 | 10/1989 |
| WO | 2011006041 | A1 | 1/2011 |

OTHER PUBLICATIONS

"Longwall Mining Automation", published by undergroundcoal.com.au; internet archive dates the page as early as 2013; Art known to applicant prior to Dec. 13, 2019; submitted copy downloaded Feb. 27, 2020.

(Continued)

*Primary Examiner* — Sunil Singh

(74) *Attorney, Agent, or Firm* — David McKenzie; David Meibos; Maywood IP Law

(57) ABSTRACT

An apparatus, system, and method for automated support of a gate entry for underground full extraction mining that includes gathering entry data for a condition of a gate entry by way of a gate entry support. The method also includes determining, by way of the gate entry support, the condition of the gate entry, advancing the gate entry support in response to determining that the condition satisfies an entry condition threshold. The method may also signal a halt condition for a production cycle, if the condition fails to satisfy the entry condition threshold.

21 Claims, 12 Drawing Sheets

(56) References Cited

U.S. PATENT DOCUMENTS

| | | | | |
|---|---|---|---|---|
| 4,710,064 | A | 12/1987 | Stafford et al. | |
| 4,906,133 | A * | 3/1990 | Martin | E21D 23/0004 405/289 |
| 5,757,805 | A | 5/1998 | Lee | |
| 6,327,260 | B1 | 12/2001 | McGrew | |
| 6,602,026 | B1 | 8/2003 | Neilson | |
| 6,754,330 | B1 | 6/2004 | Yi | |
| 7,006,528 | B1 | 2/2006 | Kokkinen | |
| 7,130,398 | B2 | 10/2006 | Yi | |
| 7,301,910 | B2 | 11/2007 | Freedman | |
| 7,463,602 | B2 | 12/2008 | Farnsworth et al. | |
| 7,680,960 | B2 | 3/2010 | Wang | |
| 8,590,982 | B2 | 11/2013 | Holme | |
| 9,670,777 | B2 | 6/2017 | Holme | |
| 9,781,643 | B2 | 10/2017 | Ekici et al. | |
| 2006/0158017 | A1 * | 7/2006 | McKenzie | E21D 19/02 299/1.7 |
| 2009/0134692 | A1 * | 5/2009 | Hargrave | E21F 17/185 299/12 |
| 2011/0006586 | A1 | 1/2011 | Holme | |
| 2012/0151076 | A1 | 6/2012 | Xun et al. | |

OTHER PUBLICATIONS

ABB Level Measurement, Webpage published through ABB, link is https://new.abb.com/products/measurement-products/level visited by applicant or applicant's attorney on or before Nov. 23, 2019; Art known to applicant prior to Dec. 13, 2019.

Barczak, Thomas M. and Stephen C. Tadolini. "Longwall Shield and Standing Gateroad Support Designs—Is Bigger Better?" (2007).

Carlson Void Scanner+, Product Page, www.carlsonsw.com website, on this page: https://www.carlsonsw.com/products/laser-measurement-devices/void-scanner/, Art known to applicant prior to Dec. 13, 2019; last accessed Dec. 3, 2019.

CAT Roof Supports Reference Catalogue, published 2017 by Caterpillar company, available from the www.cat.com/mining Art known to applicant prior to Dec. 13, 2019.

Dr. David Hainsworth, Dr. David Reid, "Roadway Development Operators' Workshop ACARP project C18023 CM2010—Continuous Miner automation", Mar. 2009, undergroundcoal.com.au website.

Fundamentals, remote control, automation, undergroundcoal.com.au website, Visited by applicant or applicant's attorney on or about Nov. 16, 2019, Art known to applicant prior to Dec. 13, 2019; p. 1.

Komatsu Mining Corp. Group, (2018) "Longwall Systems Product Overview", p. 3.

Laser Tools Co. Inc., GL350 MSHA Mining alignment Laser, Published on this page: https://lasertoolsco.com/product/gl350-msha-mining-alignment-laser/,Art known to applicant prior to Dec. 13, 2019; last accessed Dec. 3, 2019.

LM200 Laser Level Transmitter—Coal Silos Application, Brochure on this site https://new.abb.com/products/measurement-products/level/laser-level-transmitters/lm200, Art known to applicant prior to Dec. 13, 2019; last visited Dec. 3, 2019.

LongwallUSA.com, "Longwall Automation: Making Mining Safer Through Technology", Feb. 2, 2017; Art known to applicant prior to Dec. 13, 2019.

National Institute for Occupational Safety and Health, Pittsburgh, Pennsylvania, "Navigation and Control of Continuous Mining Systems" Jun. 1998.

News Article, www.abc.net.au, "CSIRO 3D laser scanner invention set to revolutionise mining, industry says", Published Nov. 3, 2019, URL: https://www.abc.net.au/news/2019-11-03/coal-mining-csiro-exscan-3d-laser-scanner-invention/11649104.

Reid, David & Ralston, Jonathon & Dunn, Mark & Hargrave, Chad. (2011). A major step forward in continuous miner automation.

S. Narendranathan, G Bungard; "The Use of Photogrammetry to Evaluate Slope Design Conformance—A Case Study from a Large Open Pit", 2011 ARMA, American Rock Mechanics Association.

Screen Capture of 3 seconds of video embedded in news Article, www.abc.net.au, "CSIRO 3D laser scanner invention set to revolutionise mining, industry says", Published Nov. 3, 2019, URL: https://www.abc.net.au/news/2019-11-03/coal-mining-csiro-exscan-3d-laser-scanner-invention/11649104.

Thomas M. Barczak, "Longwall Tailgates: The Technology for Roof Support has Improved But Optimization is Still Not There", National Institute for Occupational Safety and Health Pittsburgh Research LaboratoryPittsburgh, PA, Jun. 2003 (date found here:https://www.cdc.gov/niosh/mining/works/coversheet1704.html).

Website: ugpsrapidmapper.com—home page, Visited at least as early as Nov. 23, 2019; Art known to applicant prior to Dec. 13, 2019; last visited Mar. 23, 2020.

* cited by examiner

AUTOMATED SUPPORT OF A GATE ENTRY FOR UNDERGROUND FULL EXTRACTION MINING

CROSS-REFERENCE TO RELATED APPLICATIONS

This application claims benefit of U.S. Provisional Patent Application No. 62/780,255 entitled "Apparatus, system, and method for automated support of a gate entry for underground full extraction mining" and filed on Dec. 15, 2018 for Jefferson D. McKenzie, which is incorporated herein by reference for all purposes.

This application is related to U.S. Pat. No. 7,331,735 entitled "Apparatus, system, and method for longwall mining" and issued Feb. 19, 2008 for Jefferson D. McKenzie, which is incorporated herein by reference for all purposes.

BACKGROUND

This solution relates to full extraction underground mining and more particularly relates to supporting gate entries and/or connecting openings during longwall or short wall mining operations.

In particular, underground mining carries constant risks to workers and their safety is a primary concern. Corporate interests and government regulations constantly monitor and evaluate the working conditions to ensure the utmost safety. Underground mining includes different types of full extraction mining. Full extraction mining is generally underground mining in which substantially all of the mined mineral is removed from the mine. Examples of full extraction mining include pillar mining, short wall mining, longwall mining and the like. Examples of minerals that may be mined using full extraction mining include coal, potash, trona, salt, and the like. Although longwall mining is referenced herein as one example of full extraction mining those of skill in the art will recognize that embodiments of the claimed solution may be used in of various other types of full extraction mining.

Full extraction mining such as longwall mining may be conducted using an advancing method or a retreating method. In longwall retreat mining, a pair of tunnels are mined parallel to each other on each side of a portion of a mineral seam. These tunnels are generally referred to as gate entries, as longwall (or short wall) entries, gate roads, or simply gates referred to herein as "a gate entry" or "gate entries." The gate entries serve as the lifeline to the surface. The gate entries provide access for equipment and personnel, provide fresh air from the surface, provide two escape routes in case problems arise.

Keeping the gate entries open and safe is required for safe and efficient full extraction mining. Roof failure in gate entries is a major safety concern. Thousands of accidents occur each year due to roof failures. Roof supports are to protect the miners, but these supports can fail as well.

The mining of minerals is a large industry with constantly developing technologies that improve the safety and efficiency of the mining operations. Technology is constantly being applied in the industry to reduce manpower, equipment needs, and costs.

Due to the dangers involved, government regulations or corporate policies generally regulate how the gate entry are engineered, formed, and maintained as well as the technology and equipment used to support and keep the gate entry open and unobstructed. As full extraction mining is conducted, gate entries are susceptible to cave in of the roof and/or movement of the floor or walls which is collectively referred to herein as gate entry failure. Changes in the composition of the mineral or rock forming the roof, walls, or floor of the gate entry can also contribute to gate entry failures.

Conventional support systems for gate entry include installing and anchoring steel rods (roof, wall, or floor bolts), installing and anchoring steel cables (roof, rib, or floor cables), installing wooden or metal posts or cylinders against the floor and roof, applying glue or grout, installing concrete pillars and wedges, and/or installing steel beams or arches. These conventional support systems are installed throughout gate entries at great expense. All the materials used to support gate entry must be transported from the surface down to the gate entry within the mine. For example, the labor and material transportation costs can result in up to about $1,000 per foot. Furthermore, the materials are typically very expensive. Adding to the cost of the materials, the conventional support systems are not removed once full extraction mining is complete due to the dangers to the workers.

In addition, certain conventional gate entry support systems are passive, meaning the support systems does not support a load until the gate entry roof or floor breaks apart and begins to fail. Furthermore, the passive gate entry support systems are installed and set manually by workers which increases the expense and time required to prepare the gate entry. Conventional support mechanisms provide only a limited support capacity. Often the support mechanisms must be replaced or reinforced repeatedly to provide adequate support. These support mechanisms can be very costly and, at times, ineffective at maintaining necessary safe access to the mining area.

The inventor has identified further improvements over the state of the art. Specifically, the inventor has identified an apparatus, system, and method that is autonomous and that may operate with fewer interactions, or even any interactions with humans, such that human operators can monitor, manage, and operate a mining operation from a remote and safe location such as above ground. In addition, the apparatus, system, and method includes logic such that a plurality of gate entry supports may cooperate to sufficiently support one or more gate entries. Further, the gate entries described herein may be coupled to one or more other longwall apparatus such that the gate entries may serve to pull the longwall equipment into a mineral seam and/or guide the longwall equipment during mining operations.

SUMMARY

The claimed solution has been developed in response to the present state of the art, and in particular, in response to the problems and needs in the art that have not yet been fully solved by currently available gate entry supports. Accordingly, the claimed solution has been developed to provide an apparatus, system, and method for automated support of a gate entry for underground full extraction mining that overcomes many of the shortcomings in the art.

A method is disclosed for automated support of a gate entry for underground full extraction mining. In one embodiment, the method includes gathering entry data for a condition of a gate entry by way of a gate entry support. Next, the gate entry support determines the condition of the gate entry. If the gate entry support determines that the condition satisfies an entry condition threshold, the gate entry support advances itself, and may direct other gate entries to advance. If the gate entry support determines that the condition fails to satisfy the entry condition threshold, the gate entry support signals a halt condition for a production cycle.

An apparatus is disclosed for automated support of a gate entry for underground full extraction mining. The apparatus, in one embodiment, includes a head plate, a base, a drive unit, and one or more extension members. The extension members may include one or more of a hydraulic cylinder and a hydraulic support member. The apparatus also includes a controller and at least one sensor configured to detect one or more attributes and one or more characteristics of a gate entry.

An apparatus (e.g., a gate entry support) is disclosed for automated support of a gate entry for underground full extraction mining that includes a sensor, a drive unit, a communication module, and a controller. The sensor is configured to gather entry data. The drive unit is configured to advance a gate entry support. The communication module is configured to communicate with the controller. The controller is coupled to the drive unit and the sensor and the controller is configured to receive entry data from the sensor. The controller is also configured to determine the condition of the gate entry based on the entry data and to signal the drive unit, by way of the communication module, to move the gate entry support in response to determining that the condition satisfies an entry condition threshold.

A system is also disclosed for automated support of a gate entry for underground full extraction mining. The system includes a master gate entry support and at least two servant gate entry supports configured to move in response to commands from the master gate entry support. The master gate entry support is configured to gather entry data for a condition of a gate entry, determine the condition of the gate entry, and advance one of the one or more of the servant gate entry supports and the master gate entry support, if the system, and/or master gate entry support, determines that the condition satisfies an entry condition threshold. The master gate entry support is also configured to signal a halt condition for a production cycle, if the system, and/or master gate entry support, determines that the condition fails to satisfy the entry condition threshold.

A system is also disclosed for automated support of a gate entry for underground full extraction mining. The system includes a first gate entry support positioned within a tailgate, a second gate entry support positioned within the tailgate and parallel to the first gate entry support, a third gate entry support positioned within the tailgate and behind the first gate entry support, the third gate entry support coupled to the first gate entry support by a first linkage, and a fourth gate entry support positioned within the tailgate and behind the second gate entry support, the fourth gate entry support coupled to the second gate entry support by a second linkage. The system also includes a pan line positioned in front of a mining face, a shearer coupled to the pan line and configured to travel across the mining face, a stage loader coupled to the pan line and configured to receive mined mineral and transport the mined mineral to a transport conveyor. The system also includes a plurality of chocks positioned behind the pan line such that the pan line is positioned between the plurality of chocks and the mining face. The system is configured such that the first gate entry support, second gate entry support, third gate entry support, and fourth gate entry support are configured to monitor a condition of a tailgate and advance within the tailgate in response to the condition satisfying an entry condition threshold.

Reference throughout this specification to features, advantages, or similar language does not imply that all of the features and advantages that may be realized with the claimed solution should be, or are in, any single embodiment of the claimed solution. Rather, language referring to the features and advantages is understood to mean that a specific feature, advantage, or characteristic described in connection with an embodiment is included in at least one embodiment of the claimed solution. Thus, discussion of the features and advantages, and similar language, throughout this specification may, but do not necessarily, refer to the same embodiment.

Furthermore, the described features, advantages, and characteristics of the claimed solution may be combined in any suitable manner in one or more embodiments. One skilled in the relevant art will recognize that the claimed solution may be practiced without one or more of the specific features or advantages of a particular embodiment. In other instances, additional features and advantages may be recognized in certain embodiments that may not be present in all embodiments of the claimed solution.

These features and advantages of the claimed solution will become more fully apparent from the following description and appended claims, or may be learned by the practice of the claimed solution as set forth hereinafter.

BRIEF DESCRIPTION OF THE SEVERAL VIEWS OF THE DRAWINGS

To easily identify the discussion of any particular element or act, the most significant digit or digits in a reference number refer to the figure number in which that element is first introduced. In order that the advantages of the claimed solution will be readily understood, a more particular description of the claimed solution briefly described above will be rendered by reference to specific embodiments that are illustrated in the appended drawings. Understanding that these drawings depict only embodiments of the claimed solution and are not therefore to be considered to be limiting of its scope, the claimed solution will be described and explained with additional specificity and detail through the use of the accompanying drawings, in which:

DETAILED DESCRIPTION

The described features, structures, or characteristics may be combined in any suitable manner in one or more embodiments. In the following description, numerous specific details are provided, such as examples of materials, fasteners, sizes, lengths, widths, shapes, etc., to provide a thorough understanding of embodiments of the claimed solution. One skilled in the relevant art will recognize, however, that the claimed solution can be practiced without one or more of the specific details, or with other methods, components, materials, etc. In other instances, well-known structures, materials, or operations are not shown or described in detail to avoid obscuring aspects of the claimed solution.

Reference throughout this specification to "one embodiment," "an embodiment," or similar language means that a particular feature, structure, or characteristic described in connection with the embodiment is included in at least one embodiment of the claimed solution. Thus, appearances of the phrases "in one embodiment," "in an embodiment," and similar language throughout this specification may, but do not necessarily, all refer to the same embodiment.

Furthermore, the described features, structures, or characteristics of the claimed solution may be combined in any suitable manner in one or more embodiments. In the following description, numerous specific details are provided, such as examples of various structural components, motors, hoses, cabling, etc., to provide a thorough understanding of embodiments of the claimed solution. One skilled in the relevant art will recognize, however, that the claimed solution may be practiced without one or more of the specific details, or with other methods, components, materials, and so forth. In other instances, well-known structures, materials, or operations are not shown or described in detail to avoid obscuring aspects of the claimed solution.

Figure 1:
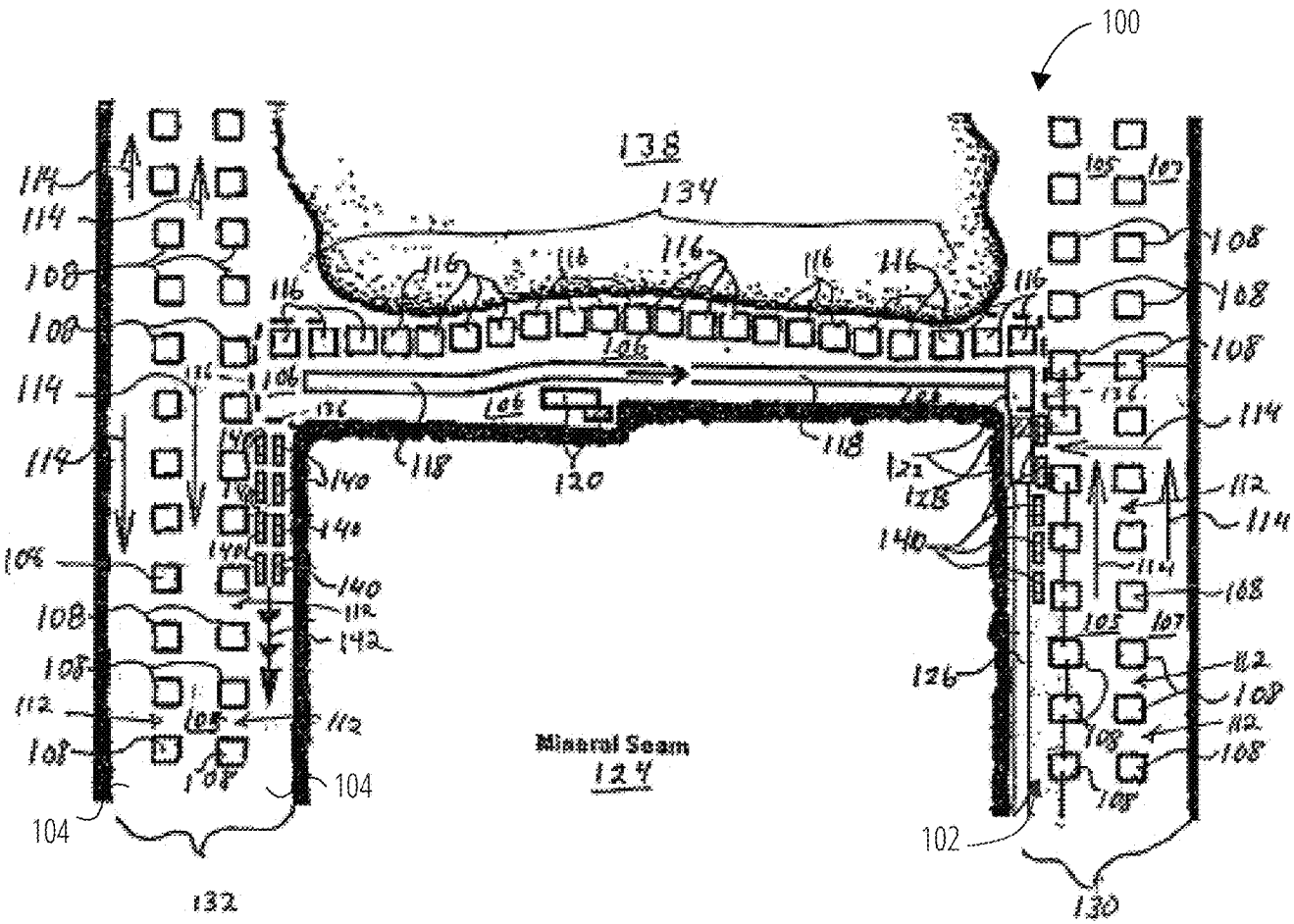
FIG. 1 is a schematic block diagram illustrating one embodiment of a mine design that utilizes embodiments of the claimed solution.

FIG. 1 illustrates a system 100 for full extraction mining that supports a gate entry for underground full extraction mining. The system 100 may include a pair of gate entries 102, 104 and a mining face 106. Gate entries 102, 104 serve as access passages to the mining face 106. The gate entries 102, 104 are used to bring in, and remove equipment, personnel, and fresh air to the mining face 106.

Typically, a gate entry is about 20 feet wide and can be very long. "Gate entry" refers to one or more of a pair of tunnels used in full extraction mining, including longwall advancing mining and longwall retreating mining. These tunnels may be parallel to each other and on each side of a mineral seam. These gate entry tunnels provide access to either side of a mineral seam for conducting full extraction mining.

The gate entries serve as the lifeline to the surface. The gate entries provide access for equipment and personnel, provide fresh air from the surface, provide two escape routes in case problems arise.

The gate entries 102, 104 connect either directly, or indirectly, to the surface of the mine. The gate entries 102, 104 may include a plurality of pillars 108 that serve as one wall of the gate entry. "Wall of the gate entry" refers to a structure within a gate entry that is formed when the gate entry is formed underground. In certain embodiments, a wall of the gate entry may be reinforced against displacement, collapse, failure, or spalling by way of ribbing. The pillars 108 may comprise the original rock or mineral or may be manmade using timbers, or concrete. Crosscuts 112 (also known as connecting entries 112) are between pillars 108. The crosscuts 112 and pillars 108 are designed to provide a maximum size gate entry 102, 104 with redundant paths to escape should parts of the gate entry 102, 104 cave in, or become sealed off.

Typically, a plurality of parallel gate entries 102, 105, 107 are cut in preparation for full extraction mining. The additional gate entries 105, 107 typically do not include the current mineral seam 124 that is to be mined. Instead, these additional gate entries 105, 107 may provide additional access or escape routes. In addition, the additional gate entries 105, 107 may facilitate movement of material, equipment, and personnel to a subsequent mineral seam for additional mining operations. As described herein, the gate entries 102, 104 that include the mineral seam 124 as one wall are discussed in great detail. However, those of skill in the art will recognize that the claimed solution can also be used in the one or more additional gate entries 105, 107.

The size of the gate entry 102, 104 also facilitates airflow and air circulation along the mining face 106. Large fans at the surface move high quantities of fresh air into the mine. Preferably, the airflow of fresh air (indicated by arrows 114) enters one gate entry 102 and flows across the mining face 106 and exits by way of the other gate entry 104. Air may also travel within the additional gate entry 105, 107. Adequate air circulation provides fresh air for the workers, reduces mineral dust created by mining of the mineral, helps to keep the equipment cooled, and removes dangerous gases that may be found in the mine.

The mining face 106, also referred to as a longwall face 106 in longwall mining operations, is an area of the mine where the mineral is being cut up and removed from the mine. "Mining face" refers to an area of a mine where a mineral is being cut up and removed from the mine. A mining face may be referred to as a longwall face.

In longwall mining, the mining face 106 includes a plurality of chocks 116, a mining face conveyor 118, a cutter 120 or shearer 120, and a stage loader 122. Those of skill in the art will readily recognize the equipment used on the mining face 106 to conduct underground full extraction mining operations. Consequently, the description here will be limited to providing adequate context for the present embodiments. Chocks 116 are a plurality of supports that hold up the roof within the mining face 106 while the mineral is being cut and loaded onto the mining face conveyor 118. "Chock" refers to a type of mining equipment configured for use with a long wall mining operation. Chocks may also be referred to as 'supports', 'roof supports', 'shields', 'powered supports', and the like. In one embodiment, a chock includes a base, a head plate, one or more hydraulic legs, and a controller. In certain embodiments, a pair of chocks may be coupled by a linkage such that operation of the linkage enables each chock of the pair of chocks to cooperate to move the pair of chocks forward or backward.

The width and length of a chock may vary depending on the size and design of the gate entry the chock will operate within. In one embodiment, the chock is about 2 meters (6.5 ft.) wide and about 3 meters (9.8 ft.) long.

"Linkage" refers to a device, apparatus, machine, unit, system, subsystem, component, assembly, or subassembly, configured to connect or couple one gate entry support to another gate entry support. In one embodiment, a linkage may comprise a solid steel bar with a coupling one each end configured to fixedly engage a hook or mount of a gate entry support.

In another embodiment, the linkage may comprise a hydraulic cylinder configured to extend to push one gate entry support away from a gate entry support configured to maintain a stationary position. Alternatively, or in addition, in such an embodiment, the hydraulic cylinder may be configured to contract to pull one gate entry support toward another a gate entry support configured to maintain a stationary position.

In another embodiment, the linkage may comprise a chain or a tether and one gate entry support may comprise a winch configured to draw up the chain or tether within away a gate entry support configured to maintain a stationary position such that a gate entry support coupled to the chain or tether advances toward the gate entry support having the winch.

The mining face conveyor 118 is a conveyor belt system that collects mineral cut from the mineral seam 124 and moves the mineral to one end of the mining face 106. "Mining face conveyor" refers to another term for a pan line. "Pan line" refers to a component of a mining system such as a longwall configured to receive a mined mineral as it is cut away from, or broken off of, a mine face. The mining face conveyor is a conveyor that carries a mineral away from a mining face. In certain embodiments, a pan line includes a conveyor system (maybe referred to as a mining face conveyor) to transport the mineral out of the pan line and to a stage loader. Pan line and mining face conveyor are used interchangeably herein.

The shearer 120 moves side to side along the exposed portion of the mineral seam 124 and cuts mineral from the mineral seam 124. "Shearer" refers to a component, machine, apparatus, or device of a mining system, such as a longwall mining system, configured to cut away, break up, shear, or remove a mineral from a mine face. A shearer may also be referred to herein as a cutter.

Typically, the chocks 116 are aligned parallel to a mineral seam 124. The mining face conveyor 118 and the shearer 120 abut the exposed surface of the mineral seam 124. The shearer 120 moves side to side along the exposed portion of the mineral seam 124 and cuts mineral from the mineral seam 124. The cut mineral falls onto the mining face conveyor 118 which moves the mineral to one end of the mining face 106. The mining face conveyor 118 delivers the mineral to the stage loader 122. "Stage loader" refers to a component, machine, apparatus, or device of a mining system, such as a longwall mining system, configured to receive a mineral and prepare the mineral for transport to the surface.

The stage loader 122 receives the mineral and prepares the mineral for transport to the surface. The stage loader 122 deposits the mineral onto a transport conveyor 126 which moves the mineral to the surface or another storage location using one or more conveyors. Typically, a stage loader 122 facilitates movement of the mineral around the corner from the mining face 106 to the gate entry 102. "Transport conveyor" refers to a component, machine, apparatus, system, subsystem, or device of a mining system, such as a longwall mining system, configured to receive a mineral transport the mineral to the surface. The stage loader 122 may include a crusher 128. The crusher 128 breaks the mineral into a consistent size to facilitate transport of the mineral to the surface.

Typically, the gate entry 102 and one or more additional gate entry 105, 107 collectively form the headgate 130. "Headgate" refers to a type of gate entry which may house a stage loader and a transport conveyor. Of course, the headgate 130 may include more than two additional gate entries 105, 107. The gate entry 104 and one or more additional gate entries 105, 107, in one embodiment, collectively form the tailgate 132. The tailgate 132 is typically a collection of parallel gate entry 104, 105, 107 that do not house the stage loader 122 and transport conveyor 126. "Tailgate" refers to a type of gate entry which is opposite the headgate and serves as a second escape route and supply for mine air ventilation.

Once the shearer 120 makes one or more passes across the mining face 106, the mining face conveyor 118 and shearer 120 advance to once again abut the exposed surface of the mineral seam 124. The stage loader 122 is also advanced toward the gate entry 102. The mining face conveyor 118 preferably uses the chocks 116 as anchors to push against to move the mining face conveyor toward the mining face. Once the mining face conveyor 118, shearer 120, and stage loader 122 are in place, the chocks 116 cooperate to advance towards the mining face conveyor 118. Collectively, the equipment within the mining face 106 may be referred to as a longwall 134. As the longwall 134 advances the roof above the mining face 106 is allowed to collapse behind the chocks 116.

The mining system 100 of FIG. 1 illustrates a mining technique known as retreat mining. In retreat mining, the gate entry 102, 104 are formed first along the mineral seam 124. The longwall 134 is installed within the mining face 106. The longwall 134 then advances into the mineral seam 124 and as the longwall 134 advances the gate entry 102, 104 shorten and transition (indicated by dashed line 136) from gate entry 102, 104 to mining face 106 and to a gob area 138 where the chocks 116 have allowed the mine roof to cave in. Consequently, the gate entry 102, 104 retreat from an original length to a shorter length as full extraction mining is performed.

As the longwall 134 advances, ground pressures above the mine change as well. These transferred ground pressures are known as pressure abutments and advance with the longwall face 106 as the longwall face 106 advances during recovery (mining) of the mineral. These pressure abutments can cause the mine roof and/or mine floor within the gate entry 102, 104 to fail (cave in or up heave). Such failures can severely restrict the flow of materials, personnel, and air to the mining face 106. Catastrophic failures can close off one gate entry 102, 104 and in some cases both gate entry 102, 104.

In one embodiment, the mining system 100 includes one or more gate entry supports 140. "Gate entry support" refers to a machine, apparatus, device, system, subsystem, component, or module configured engage a mine roof and/or mine floor for the purpose of keeping a gate entry open and free of any blockage or constrictions to free ingress and/or egress within the gate entry. In certain embodiments, the gate entry support is configured to support a mine roof, mine floor, and/or gate entry walls from collapse or deformation when exposed to a front abutment load. In certain embodiments, the gate entry support is configured to move/advance as part of conducting full mineral extraction operation (one or more mining production cycles).

Preferably, the gate entry supports 140 are placed strategically within one or more gate entry 102, 104. The gate entry supports 140 preferably extend vertically to support both the mine roof and the mine floor within a gate entry 102, 104. In addition, or alternatively, the gate entry supports 140 may extend a support laterally to support one or both walls of a gate entry 102, 104. Preferably, the gate entry supports 140 are configured such that minimal airflow is impeded flowing between the gate entry 102, 104 and the mining face 106. Advantageously, the gate entry supports 140 may be retracted and moved forward (see arrow 142) within a gate entry 102, 104 to provide support as pressure abutments move forward during full extraction mining.

In certain embodiments, the gate entry supports 140 may not be physically connected to the longwall 134. In other words, there may be no direct connection between a gate entry support 140 and the mining face conveyor 118. This independence may permit gate entry supports 140 to be positioned well ahead of the longwall 134 to prevent any mine floor or mine roof failures due to the advancing pressure abutments.

Use of gate entry supports 140 saves time and expense because less time is required to properly position and install each gate entry support 140. In addition, because the gate entry supports 140 move with the longwall 134 the gate entry supports 140 are not left behind as with other conventional passive systems.

The gate entry supports 140 are also capable of higher load support capacities than conventional support systems. Preferably, the gate entry supports 140 are capable of each supporting between about 500 tons and up to about 1000 or more tons. Preferably, the gate entry supports 140 are positioned parallel to the gate entry 102, 104 such that minimal airflow and gate entry width is obstructed by the gate entry supports 140. Preferably, the gate entry supports 140 have a width of up to about 5 feet. In this manner, one or more gate entry supports 140 may be positioned alongside a stage loader 122 or transport conveyor 126 without adversely impeding the airflow. The minimal width of the gate entry supports 140 also allows workers to easily pass by the gate entry supports 140 to access the mining face 106.

Figure 2:
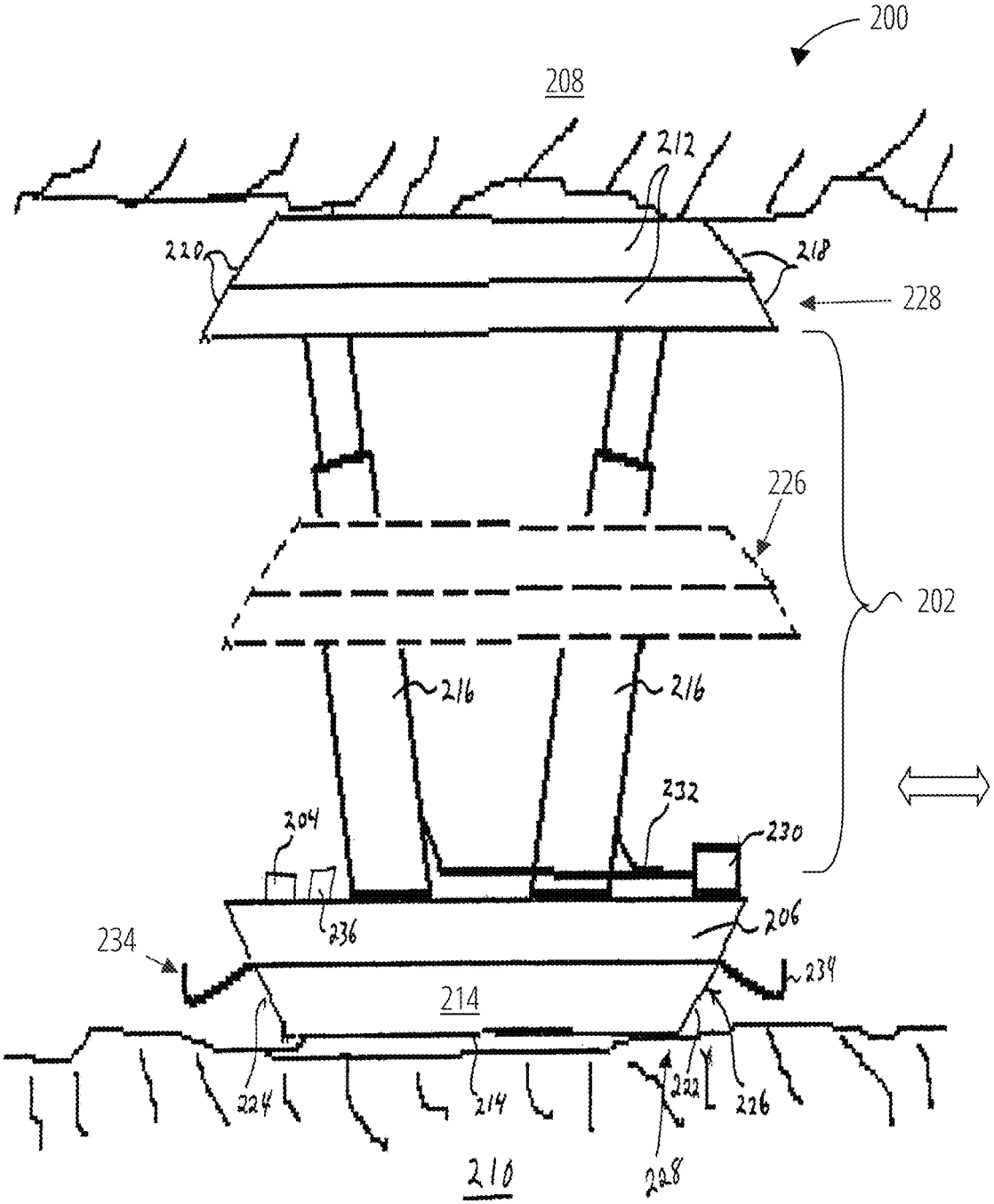
FIG. 2 is a side view illustrating one embodiment of gate entry support.

FIG. 2 illustrates a side view of one embodiment of a gate entry support 200 for supporting a gate entry 102, 104 for underground full extraction mining. The gate entry support 200 includes a support member 202, a controller 204, and a drive unit 206. The support member 202 is configured to selectively engage a mine roof 208 and a mine floor 210 within a gate entry 102, 104.

The support member 202 supports a pressure load from the mine roof 208, or mine floor 210, as full extraction mining operations are conducted. Preferably, the pressure which the support member 202 exerts can be adjusted by the controller 204. If needed, a support member 202 may engage the mine roof 208 and mine floor 210 with minimal pressure and serve as a passive gate entry support. Alternatively, the support member 202 may actively provide pressure to the mine roof 208 and/or mine floor 210. Preferably, the support member 202 is oriented perpendicular to the mine roof 208 and/or mine floor 210 and extends vertically with respect to the gate entry 102, 104.

The support member 202, in one embodiment, may include a head plate 212, a base 214, and an extension member 216. The head plate 212 engages the mine roof 208. Preferably, the head plate 212 is a steel reinforced plate with an angled front 218 and an angled back 220. The angled front 218 and back 220 permit the head plate 212 to slide past irregularities in the mine roof 208. Preferably, the head plate 212 is substantially planar. Alternatively, the head plate 212 is curved or otherwise formed to conform to the contour of the mine roof 208.

The base 214 engages the mine floor 210. Preferably, the base 214 is a steel reinforced plate with an angled front 222 and an angled back 224. The angled front 222 and back 224 permit the base 214 to slide past irregularities in the mine floor 210. Preferably, the base 214 is substantially planar. Alternatively, the base 214 is curved or otherwise formed, fabricated, or of a material, to conform to the contour of the mine floor 210.

The extension member 216 extends from a retracted position 226 to an extended position 228. In the retracted position 226, the extension member 216 draws the head plate 212 (in phantom) and base 214 in close proximity to the drive unit 206 such that the height of the gate entry support 200 is minimized. In the extended position 228, the extension member 216 extends the head plate 212 and base 214 to respectively engage the mine roof 208 and mine floor 210. In certain embodiments, the base 214 and drive unit 206 are integrated into a single unit. The extension member 216 preferably extends and retracts the head plate 212 and/or the base 214 in response to a control signal from the controller 204. Alternatively, or in addition, the extension member 216 may include manual controls that permit a worker to extend or retract the head plate 212 and/or the base 214. In certain embodiments, the extension member 216 communicates with a sensor that indicates how much pressure the extension member 216 is exerting against the mine roof 208 and/or mine floor 210.

In certain embodiments, the gate entry support 200 comprises a plurality of extension members 216. In addition, the head plate 212 and/or base 214 may be divided to provide more flexibility in how the pressure is distributed to the mine roof 208 or mine floor 210. In one embodiment, the extension member 216 comprises a hydraulic ram that includes a fluid chamber and a telescoping piston. The hydraulic ram may be coupled to a pressurized hydraulic fluid supply 230 by a plurality of hydraulic hoses 232. The hydraulic fluid supply 230 may reside on the gate entry support 200. Alternatively, the hydraulic fluid supply 230 may be remotely connected by the hoses 232 to one or more extension members 216, which may comprise hydraulic rams.

In one embodiment, the extension member 216 comprises one or more of a hydraulic cylinder and a hydraulic support member. "Hydraulic support member" refers to one or more hydraulic cylinders configured to extend a head plate of a gate entry support to engage a mine roof and optionally extend a base of the gate entry support to engage a mine floor. In one embodiment, activation (e.g., extension or retraction) of a hydraulic support member causes movement of the head plate and/or base in a vertical direction relative to the mine floor.

The controller 204 directs the operation of the support member 202 and the drive unit 206. Preferably, the controller 204 is coupled by electronic communication links such as wired control signals, wireless control signals, or radio control signals to direct and control extension of the extension member(s) 216 of the support member 202 to engage the mine roof 208 and mine floor 210.

"Controller" refers to any hardware, device, component, element, circuitry, logic, software, firmware, or circuit configured to manage and control operation of another software, hardware, firmware, device, apparatus, or logic unit, component, device, or component. In one embodiment, the controller is configured to operate a gate entry support autonomously. This means that the controller, in one embodiment, is configured to gather entry data, assess the condition of a gate entry, advance or retreat the gate entry support, and/or signal a halt condition to a production cycle without input or control signals from an external source such as an operator, a longwall controller, or the like.

"Circuitry" refers to electrical circuitry having at least one discrete electrical circuit, electrical circuitry having at least one integrated circuit, electrical circuitry having at least one application specific integrated circuit, circuitry forming a general purpose computing device configured by a computer program (e.g., a general purpose computer configured by a computer program which at least partially carries out processes or devices described herein, or a microprocessor configured by a computer program which at least partially carries out processes or devices described herein), circuitry forming a memory device (e.g., forms of random access memory), or circuitry forming a communications device (e.g., a modem, communications switch, or optical-electrical equipment).

"Firmware" refers to software logic embodied as processor-executable instructions stored on volatile memory media and/or non-volatile memory media. "Non-volatile memory media" refers to any hardware, device, component, element, or circuit configured to maintain an alterable physical characteristic used to represent a binary value of zero or one after a primary power source is removed.

"Autonomous" or "Autonomously" refers to a state of operation for a gate entry support in which certain functionality, determinations, and operations are performed without aide or input from human operators or controllers. In one embodiment, the gate entry support is configured to determine a condition for a gate entry without any input or instruction or guidance from a human. In addition, or alternatively, in one embodiment, the gate entry support is configured to determine whether to advance a gate entry support without any input or instruction or guidance from a human. In addition, or alternatively, in one embodiment, the gate entry support is configured to signal a halt condition for a production cycle without any input or instruction or guidance from a human.

In other embodiments, a gate entry support may be semi-autonomous and may thus perform certain functionality and may rely on human input for other functionality.

Preferably, different control signals from the controller 204 retract the head plate 212 and/or base 214 to disengage the gate entry support 200 from the mine roof 208 and/or mine floor 210. The controller 204 is preferably an electronic device designed to operate in potentially harsh conditions of underground mining. In one embodiment, the controller 204 may be on the gate entry support 200 or may be integrated with, or part of, other controllers for a longwall 134, such as a longwall controller. A power supply for the controller 204 may reside on the gate entry support 200 or be provided by a remote power supply (not shown) through a cable.

"Longwall controller" refers to any hardware, device, component, element, circuitry, logic, or circuit configured to manage and control operation of another software, hardware, firmware, device, apparatus, or logic unit, component, device, or component. In certain embodiments, a longwall controller is configured to control the movement and operation of a pan line, a shearer, chocks, a stage loader, and a transport conveyor. In such embodiments, the longwall controller may be configured to communicate with one or more gate entry supports.

In one embodiment, the controller 204 is programmed with microcode to extend or retract the head plate 212 or base 214 independent of each other. Alternatively, the controller 204 may extend or retract the head plate 212 and/or base 214 with equal amounts of pressure. Preferably, the controller 204 is configured to take up minimal space such that the overall profile of the gate entry support 200 viewed from one end is minimal such that airflow is minimally impeded.

The drive unit 206 is preferably connected to the support member 202 and controller 204. "Drive unit" refers to a device, apparatus, machine, unit, system, subsystem, component, assembly, or subassembly, configured to move a gate entry support in a direction, such as forward or backwards. In one embodiment, a drive unit comprises a linkage coupled between a gate entry support and an anchor or another gate entry support or another stationary object, such that activation (e.g., extending or retracting) of the linkage causes the gate entry support to move.

In one embodiment, the drive unit comprises one or more of a vehicle, a tram, a crawler, a dolly, a walking base, a sled, a horizontal ram configured to act on an anchor, or the like.

The drive unit 206 serves to facilitate movement of the gate entry support 200 for initial positioning and repositioning during full extraction mining operations. The drive unit 206 moves the support member 204 in response to a motive force and a command from the controller 204. In certain embodiments, the motive force is a push, or a pull force provided by other mining equipment, such as another gate entry support.

Those of skill in the art will recognize that the drive unit 206 may comprise a drive unit 206 that includes means for moving the gate entry support 200 under a motive force generated by the drive unit 206. For example, the drive unit 206 may include a motor 236 that provides the motive force, such a hydraulic pressure, electricity, and the like to one or more hydraulic cylinders, wheels, tracks, crawling feet or other means for moving the gate entry support 200 forward, backward, or side to side. The motor 236 may comprise an electric motor, a hydraulic motor, or an internal combustion motor. The motor 236 of the drive unit 206 responds to control commands from the controller 204. In one embodiment, the drive unit 206 may comprise a tram, a crawler, a dolly, a walking base, or a horizontal hydraulic cylinder, such as a linkage, that acts on an anchor such as an anchor bolt or a chock 116 of the longwall 134.

"Anchor" refers to an operating state of a gate entry support. In this operating state, the gate entry support employs either its mass or its holding pressure or a combination of these to serve as a secure point that resists movement when acted upon by another force such as by another gate entry support for example by way of a linkage. Of course, anchor may also be used herein to refer to any object, device, or structure that is configured to maintain its position when acted upon by an external force.

In one embodiment, the support member 202, controller 204, and drive unit 206 are not physically connected to, or constrained by a mining face conveyor 118. In such an embodiment, the gate entry support 200 can be operated independent of a longwall 134. In particular, the gate entry support 200 can be used in room and pillar mining for retreat mining. For example, the independent movement and operation of the gate entry support 200 provides additional support and moveable, reusable supports in a pillar line or cave line area for room and pillar mining. In addition, the independent movement and operation of the gate entry support 200 allows the gate entry support 200 to be used in other areas of a mine having known weak ground conditions.

In another embodiment, the gate entry support 200 is physically coupled to one or more parts of a longwall 134. For example, the gate entry support 200 may be coupled by a linkage to a pan line (e.g., mining face conveyor 118). In such an embodiment, the gate entry support 200 can be operated in conjunction with a longwall 134. In such an embodiment, the gate entry support 200 may be used to steer and direct a longwall 134. For example, by adjusting the positions of one or more gate entry supports 140 within the gate entry, the direction of the longwall 134 can be changed.

Figure 3:
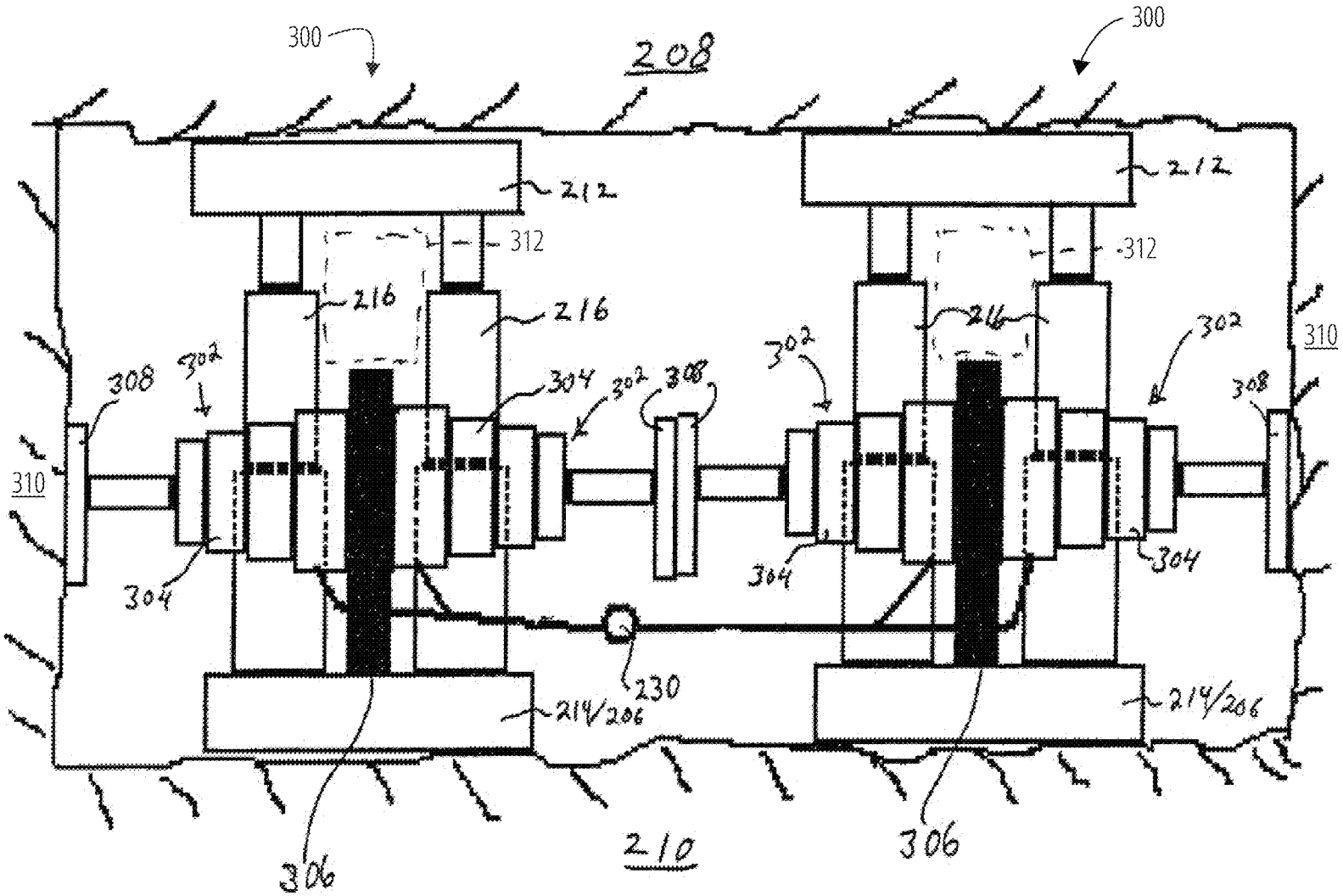
FIG. 3 is an end-view illustrating an aligned profile of a pair of gate entry supports.

FIG. 3 illustrates an end view of one embodiment of a pair of gate entry supports 300 for supporting a gate entry 102, 104 for underground full extraction mining. The gate entry supports 300 includes certain components in common with the embodiment described in relation to FIG. 2. These common components are identified by common reference numerals. Preferably, the gate entry supports 300 includes a support member 202 that extends vertically. The support member 202 includes one or more extension members 216, a head plate 212, and a base 214.

In one embodiment, the gate entry supports 300 include at least one lateral extension member 302. "Lateral extension member" refers to one or more hydraulic cylinders configured to extend a side plate of a gate entry support to engage a wall of the gate entry and optionally extend another side plate of the gate entry support to engage an opposite wall of the gate entry. In one embodiment, activation (e.g., extension or retraction) of a lateral extension member causes movement of one or more side plates in a horizontal direction relative to the mine floor.

In certain embodiments, the gate entry supports 300 include a pair of opposing lateral extension members 302. The lateral extension member 302 may include substantially the same components as the extension member 216. For example, the lateral extension member 302 may include a hydraulic ram 304 that includes a fluid chamber, one or more telescoping pistons, and a side plate 308. A base of the hydraulic ram 304 may be secured to a frame member 306.

The hydraulic ram 304 may also be coupled to the side plate 308. "Side plate" refers to a planar structure configured to withstand high pressures pushing the side plate against a wall of a gate entry. In certain embodiments, the side plate is made of a metal such as steel. The side plate may be a solid structure or may include holes in the side plate of various patterns.

The lateral extension member 302 is configured to extend and retract laterally in response to suitable extend or retract control signals. Preferably, the control signals are provided by the controller 204. The lateral extension member 302 extends to engage a wall of the gate entry 102, 104 with the side plate 308. The lateral extension member 302 retracts the side plate 308 to disengage from a gate entry wall. Preferably, the side plate 308 is a metal planar structure. Alternatively, the side plate 308 is contoured to match a contour of the gate entry wall 310.

In one embodiment, the gate entry support 300 is configured such that all the components of the gate entry support 300 cooperate and are positioned in order to minimize the profile of the gate entry support 300 when viewed from each end as illustrated in FIG. 3. For example, a plurality of extension members 216 may be aligned. In addition, rather than a single wide extension member 216 a plurality of narrower extension members 216 may be aligned within each other in order to provide suitable load capacity but minimize the end profile. In addition, the controller 204, motors 236, and hydraulic fluid supply 230 may be aligned. The head plate 212, base 214, and side plates 308 may be as thin as possible in order to minimize the end profile of the gate entry support 300. In this manner, the passages 312 for airflow are maximized. Consequently, airflow past the gate entry support 300 is maximized, provided the gate entry support 300 is positioned parallel to the gate entry 102, 104.

In certain embodiments, the gate entry support 300 comprises an existing support selected from the group of support members comprising a shield support, a chock support, a chock shield support, and a chock. Each of these existing supports may be modified and adapted to move forward within the gate entry or a connecting entry. For example, in one embodiment a pair of existing supports may be coupled together by a bar or linkage. The coupled pair of existing supports may then cooperate to walk forward within the gate entry or a connecting entry to reposition the gate entry support 200. One existing gate entry support 300 may engage the mine roof 208 and mine floor 210 to provide an anchor of the other existing gate entry support 300 to use to move within the gate entry. Preferably, use of existing gate entry support 300 includes modification, removal, or adaptation of any existing canopies on the existing supports such that airflow past the existing support is maximized.

Figure 4:
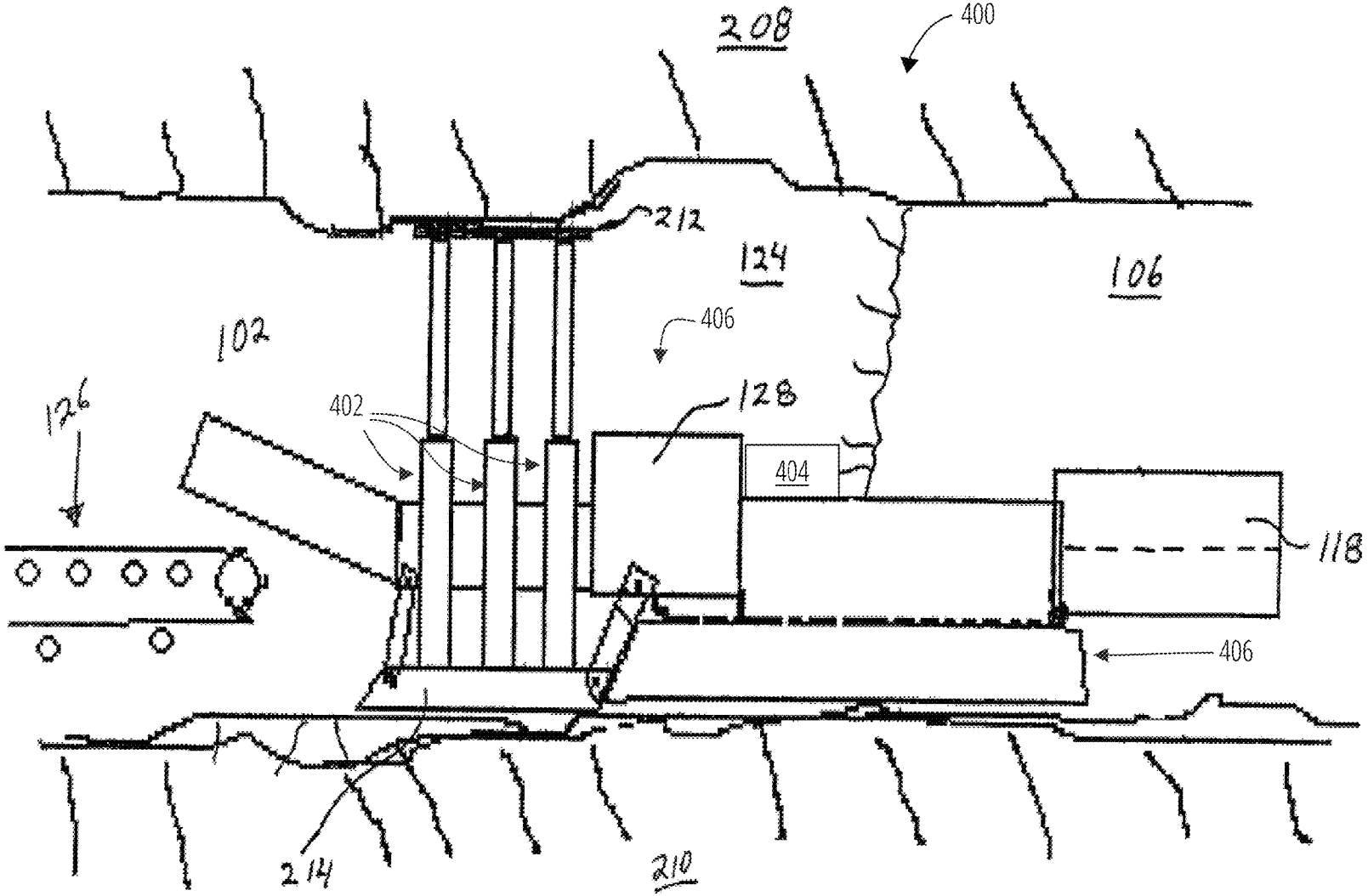
FIG. 4 is a side view illustrating one embodiment of a gate entry support.

FIG. 4 illustrates one embodiment of a system 400 for supporting a gate entry 102 for underground full extraction mining. The system 400 includes certain components in common with the embodiments described in relation to FIG. 1 and FIG. 2. These common components are identified by common reference numerals. The system 400 preferably includes one or more hydraulic support members 402 connected to a head plate 212 and a base 214. The system 400 also includes a controller 404 that operates substantially the same as the controller 204 described above in relation to FIG. 2. The hydraulic support members 402 respond to control commands from the controller 404. The system 400 includes a stage loader 406 similar to the stage loader 122 described in relation to FIG. 1. However, the stage loader 406 is coupled to the hydraulic support members 402. The stage loader 406 is within the gate entry 102. Consequently, the stage loader 406 is configured to move the hydraulic support members 402 when the stage loader 406 moves. The stage loader 406 may be moved in response to advancement of a longwall face 105. Preferably, the controller 404 communicates with or operates in concert with a controller for the stage loader 406 such that when the stage loader 406 is prepared to move the controller 404 retracts the hydraulic support members 402 to facilitate such movement.

In certain embodiments, the hydraulic support member 402 is a support member selected from the group of support members comprising a shield support, a chock support, a chock shield support, and a chock. Each of these existing forms of support may be modified and adapted to be coupled to the stage loader 406 such that movement of the stage loader 406 also moves the hydraulic support member 402. Alternatively, movement of the hydraulic support member 402 may cause the stage loader 406 to move. Alternatively, the hydraulic support member 402 may be specifically engineered to operate as part of a stage loader 406.

In a preferred embodiment, the hydraulic support member 402 and controller 404 are configured to maximize airflow past the system 400. For example, the controller 404 may be positioned directly in-line with an existing component such as the crusher 128 such that adding the controller 404 does not further impede airflow. Similarly, the width of the hydraulic support member 402 may be selected in order to minimize interference with airflow past the system 400. In one embodiment, a plurality of hydraulic support members 402 are used instead of one larger width hydraulic support member 402. Furthermore, where a plurality of hydraulic support members 402 are used these hydraulic support members 402 may be aligned such that the end profile of the system 400 is minimized. The system 400 illustrates one set of hydraulic support members 402. Of course, the system 400 may include a plurality of sets of hydraulic support members 402 each with its own head plate 212 and base 214.

Figure 5:
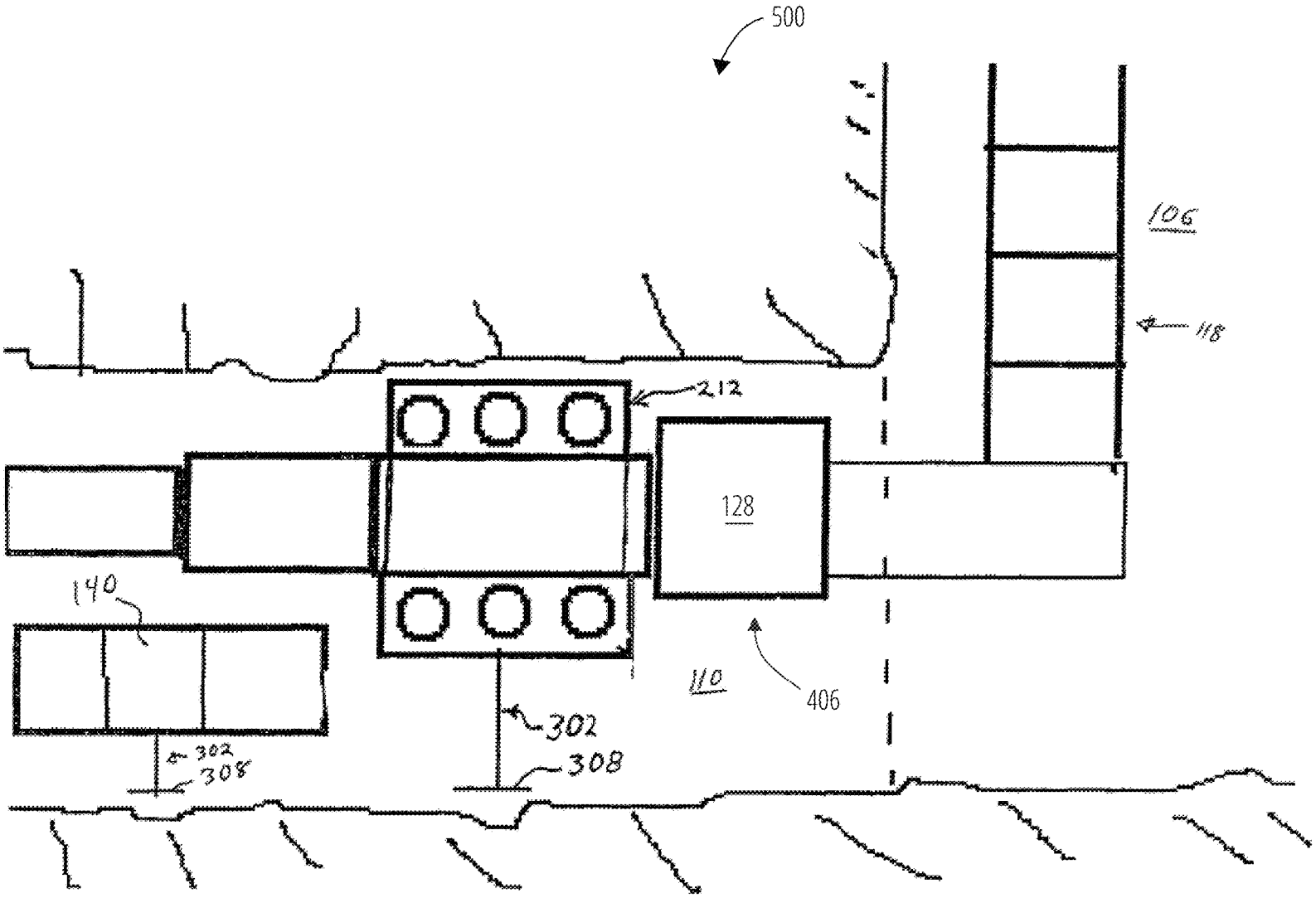
FIG. 5 is a top plan view illustrating one embodiment of a gate entry support.

FIG. 5 illustrates a top plan view of a system 500 for supporting a gate entry 102 for underground full extraction mining. The system 500 includes hydraulic support members 402 with head plates 212 such as those on the system 400 in FIG. 4. The system 500 also includes lateral extension members 302 similar to the lateral extension members of FIG. 3. Preferably, the lateral extension members 302 are physically coupled to the stage loader 406. In a preferred embodiment, the lateral extension members 302 oppose each other. In certain embodiments the lateral extension member 302 on one side may be configured to extend further than the lateral extension member on the opposite side. This may be useful in mining operations in which the stage loader 406 is not centered between the walls of the gate entry 102. In this manner, the longer lateral extension member 302 is configured to move the side plate 308 sufficiently to engage the opposing gate entry wall.

In other embodiments, the lateral extension members 302 are positioned nearer the mine floor 210 than the mine roof 208. In this manner, the lateral extension members 302 facilitate passage over the lateral extension members 302 by personnel accessing the mining face 106 or exiting the mining face 106. Alternatively, the lateral extension members 302 are positioned nearer the mine roof 208 than the mine floor 210. As described above, the lateral extension members 302 may be selectively extended and retracted as needed to engage the walls of the gate entry 102. Selective extension and retraction of one lateral extension member 302 or the other may be controlled by suitable control signals.

Figure 6:
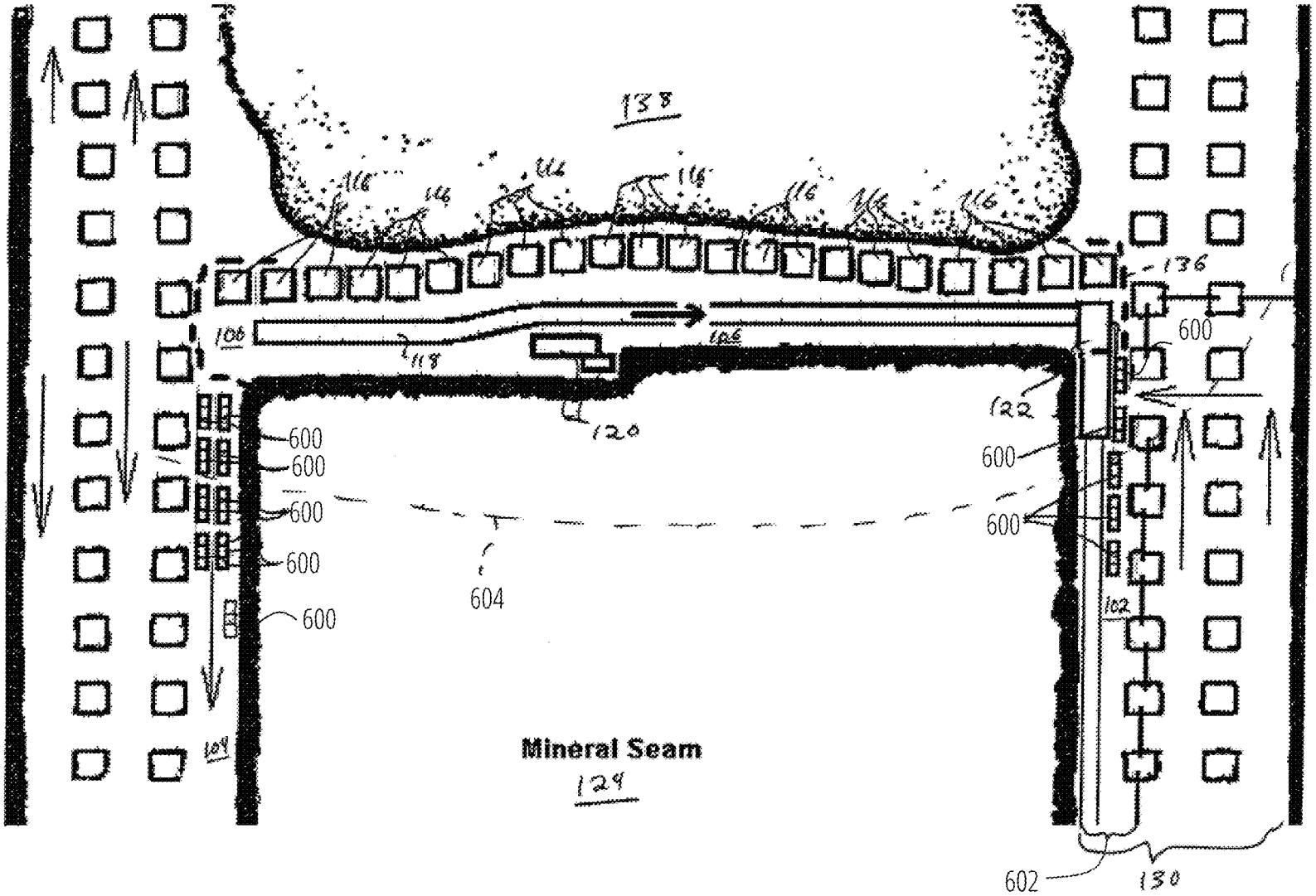
FIG. 6 is a schematic block diagram illustrating one embodiment of a mining layout for supporting one or more gate entry supports 600.

FIG. 6 illustrates one embodiment of a mining layout for supporting one or more gate entry for underground full extraction mining using a gate entry support 600 in accordance with the claimed solution. The gate entry support 600 may comprise the gate entry support 140 illustrated in FIG. 1, the gate entry support 200 described in relation to 200, or the gate entry support 300 described in relation to FIG. 3. The gate entry support 600 includes a support member 202, a controller 204, and a drive unit 206 coupled together and may operate independent of a mining face conveyor 118.

Initially, before full extraction mining begins, a gate entry support 600 is positioned within a headgate 130. Optionally, a gate entry support 600 may be positioned within the tailgate 132. The gate entry supports 600 are preferably positioned parallel to the gate entry 102, 104. Preferably, each gate entry support 600 is positioned within a gate entry 102, 104 to form an access passage 602. The access passage 602 provides a passageway for equipment, personnel, and air to move freely between other parts of a mine and the mining face 106. Preferably, the access passage 602 includes the width of the gate entry support 600 with respect to airflow because an end profile of the gate entry support 600 is minimal.

In addition, the gate entry support 600 may be strategically positioned just ahead of a front abutment loading 604. Positioning of the gate entry support 600 may include extending the extension member 216 to engage the mine roof 208 and mine floor 210. One or more extension members 216 may support between about 500 tons and about 1000 or more tons. Alternatively, or in addition, one or more lateral extension members 302 are extended to engage walls of the gate entry 102, 104. Preferably, the extension members 216 and/or lateral extension members 302 extend in response to a control signal from the controller 204.

In one embodiment, the gate entry supports 600 may assist in keeping the mining face conveyor 118 aligned with a stage loader 122 or transport conveyor 126. In one embodiment, the gate entry supports 600 may pull the mining face conveyor forward. Alternatively, the gate entry support 600 may not provide alignment or movement assistance. Consequently, the gate entry supports 600 provide flexibility in providing support where needed. The gate entry supports 600 can be operated and moved independent of the operation and movement of the mining face conveyor 118 or other longwall equipment.

Positioning of the gate entry supports 600 may also include positioning of support cabling and support hoses for extraction mining equipment. Preferably, the support cabling and support hoses are positioned within the access passage. The gate entry supports 600 prevent cave ins such as wall, floor, or roof failures that may cover or damage the support cabling and support hoses.

Next, full extraction mining operations are conducted. As the mining face 106 moves into the gate entry 130, 132, the front abutment loading 604 moves further into the mineral seam 124. Advantageously, the gate entry support 600 was positioned within an area of the gate entry 104 having weak structural conditions. Consequently, as the front abutment loading 604 arrives over the weak area of the gate entry 104, the gate entry support 600 is providing positive support to the area so that failure of the gate entry 104 can be prevented.

As full extraction mining shortens the gate entry 102, 104 and the gate entry supports 600 begin to enter the mining face 106, the controller 204 may operate autonomously to reposition the gate entry supports 600 further down along the length of the gate entry 102, 104. The gate entry supports 600 may advance using contact advance or non-contact advance. Repositioning of the gate entry supports 600 allows for reuse of the gate entry supports 600 and facilitates keeping the access passage 602 substantially unblocked during full extraction mining operations.

Figure 7:
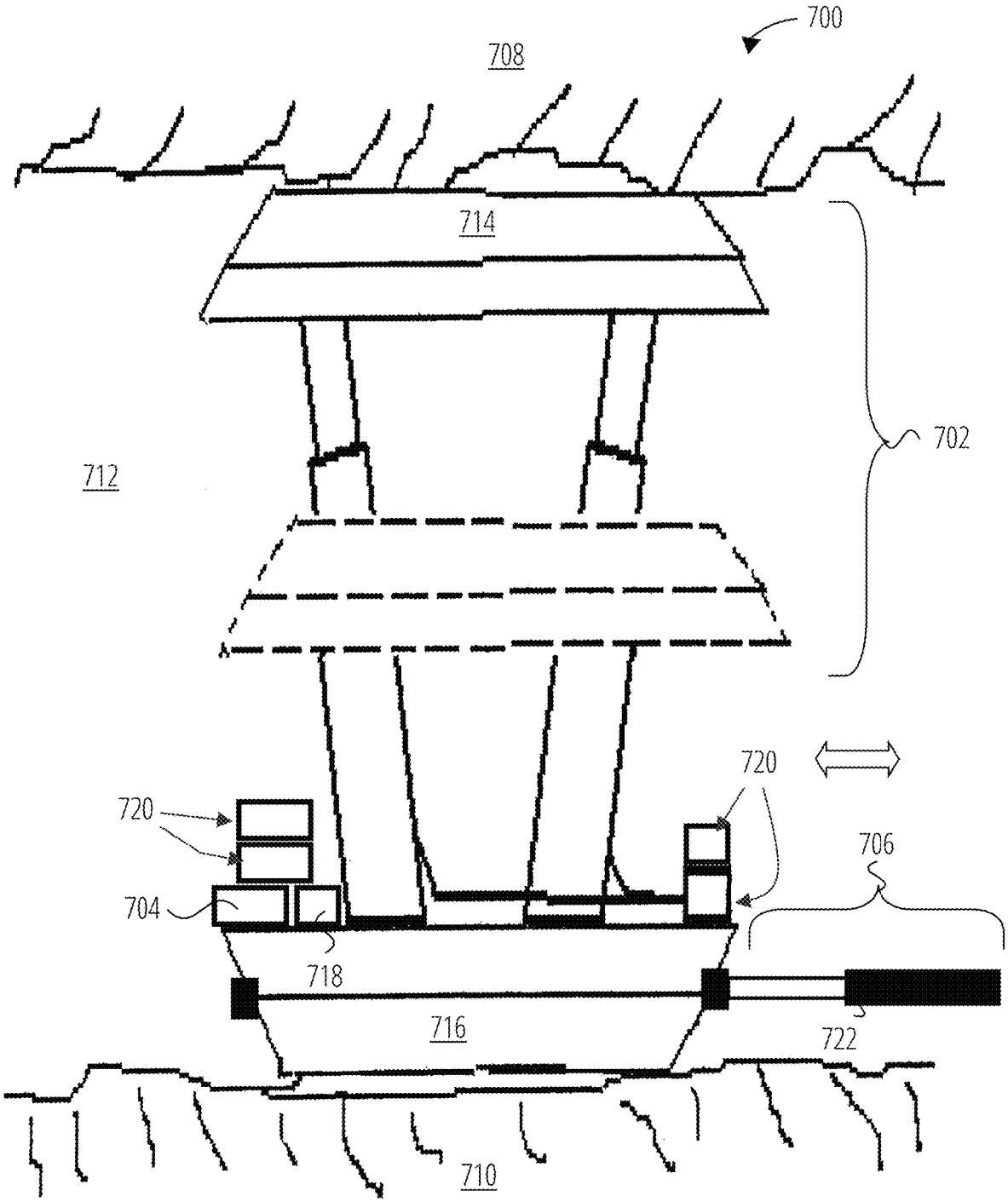
FIG. 7 illustrates a gate entry support in accordance with one embodiment.

FIG. 7 illustrates a side view of one embodiment of a gate entry support 700 for supporting a gate entry for underground full extraction mining. The gate entry support 700 includes a support member 702, a controller 704, and a drive unit 706. The support member 702 is configured to selectively engage a mine roof 708 and a mine floor 710 within a gate entry 712. The support member 702 may include many, if not each of the same components of the gate entry support 200, illustrated in FIG. 2. For example, the support member 702 may also include a head plate 714 and a base 716.

The support member 702 supports a pressure load from the mine roof 708, or mine floor 710, as mining operations are conducted. Preferably, controller 704 may adjust the pressure which the support member 702 exerts. The pressure exerted by the support member 702 between the mine roof 708 and mine floor 710 and/or against one or more walls of the gate entry 712 are referred to herein as a holding pressure.

"Holding pressure" refers to an amount of pressure exerted by one or more hydraulic support members and/or by one or more lateral extension members between a mine roof and mine floor and between walls of the gate entry, respectively. In certain embodiments, the holding pressure is expressed in tons per square foot and the holding pressure may range from between about 12 to 20 or more tons per square foot.

The controller 704, in one embodiment, directs the operation of the support member 702 and the drive unit 206 and other components of the gate entry support 700. In certain embodiments, the controller 704 may also direct operations of one or more other gate entry supports 700, such as servant gate entry supports. Preferably, the controller 204 is coupled by electronic communication links, such as wired control signals, wireless control signals, or radio control signals to direct and control extension of the support members 702 to engage the mine roof 708 and mine floor 710. Alternatively, or in addition, the controller 704 may be coupled to a communication module 718. "Communication module" refers to any hardware, device, component, firmware, software, element, circuitry, logic, or circuit configured to send messages, signals, packets, or data to and receive messages, signals, packets, or data from another hardware, device, component, firmware, software, element, circuitry, logic, or circuit by way of a wired or wireless media.

The communication module 718 enables one gate entry support 700 to communicate data and/or commands to one or more of components of the gate entry support 700, a servant gate entry support, a longwall controller, or another controller. The communication module 718 may transfer data, such as entry data, and/or commands using wired or wireless communication links.

Preferably, different control signals from the controller 704 retract the head plate 714 and/or base 716 to disengage the gate entry support 700 from the mine roof 708 and/or mine floor 710. The electronic components of the gate entry support 700 are designed to operate in potentially harsh conditions of underground mining.

In one embodiment, the controller 704 is programmed with microcode, firmware, and/or software to extend or retract the head plate 714 and/or base 716 independent of each other. In addition, the controller 704 communicates with one or more sensors 720. The controller 704 uses the sensors and data from the sensors to conduct autonomous operation. "Sensor" refers to any hardware, device, component, element, circuitry, chip, or circuit configured to detect a characteristic of an object, a space, a void, a gas, or the like. In certain embodiments, the sensor may comprise a holding pressure sensor, a seismic sensor, a camera, a 3D laser scanner, an air quality sensor, a position sensor, a LIDAR sensor, and an egress sensor.

In one embodiment, the gate entry support 700 includes a plurality of sensors 720, including but not limited to a holding pressure sensor, a 3D laser scanner, an air quality sensor, a position sensor, a LIDAR sensor, an egress sensor, one or more of cameras, a seismic sensor, and the like. "Holding pressure sensor" refers to a sensor configured to measure and report a holding pressure. "Seismic sensor" refers to a sensor configured to detect and/or measure seismic activity. "Seismic activity" refers to a measure of vibrations, tremors, and other movement in the earth in and around a gate entry. "Air quality sensor" refers to a device, component, circuit, system, chip, or circuitry configured to detect and/or measure one or more characteristics of matter such as a gas, including air.

In one embodiment, the air quality sensor detects and/or measures levels of certain elements and/or particulates in a gas or a gas mixture, including, but not limited to, air. "Gas" refers to any substance or combination of substances in a gaseous state of matter. Furthermore, as used herein gas refers to substances that are a pure composition of one or more elements as well as substances that include contaminants, both gaseous contaminants and particulate contaminants.

"Position sensor" refers to a sensor configured to determine a position of a gate entry support and/or of one or more gate entry supports within a gate entry. The position sensor may determine a position between two walls of the gate entry and/or may determine a position between one end of the gate entry near a mining face and an opposite end of the gate entry. "Egress sensor" refers to a sensor configured to determine whether a gate entry alone and/or in combination with one or more gate entry supports is sized and/or configured to permit personnel to exit from the mining face by way of the gate entry.

Those of skill in the art will recognize that the gate entry support 700 may include other sensors that may provide data, such as entry data, to enable the gate entry support 700 to operate autonomously. In addition, those of skill in the art will recognize that the gate entry support 700 may include various accessories to enable suitable use of the sensors (e.g., power supplies, power cabling, lights, etc.). In addition, those of skill in the art will recognize a variety of different sensors that may be included on a gate entry support 700. For example, a LM200 Laser Level from ABB Analytical Measurements Level Products of Quebec, Canada is on example of a suitable sensor that may be used with the gate entry support 700. Certain sensors may be used for gathering of entry data and/or for use in positioning the gate entry support 700 within the gate entry 712. For example, a GL350 MSHA Mining Alignment Laser from Laser Tools Co. Inc. Of Little Rock, Ark. may be a suitable sensor for use on the gate entry support 700 and may serve both to gather entry data and position or align the gate entry support 700 within the gate entry 712.

In one embodiment, the controller 704 communicates with one or more sensors to gather entry data. "Entry data" refers to data, records, readings, measurements, mappings, data values, findings, and the like regarding the condition of a gate entry. Examples of entry data include, but are not limited to width measurements for the gate entry, length measurements for the gate entry, height measurements for the gate entry, LIDAR readings, radar readings, sonar readings, obstacle detection readings, and the like.

The controller 704 may receive or gather entry data from one or more of the sensors 720. In one embodiment, logic of the controller 704 may determine a condition for the gate entry 712 using the entry data. "Condition" refers to a present state of a gate entry. Gate entries may have various states depending on the physical condition and environment of the gate entry. In one embodiment, the gate entry may comprise a state such as one of clear (as in clear of any obstacles to free ingress and/or egress of personnel and/or equipment), blocked (as in a predefined width clearance and/or height clearance or free ingress and/or egress of personnel and/or equipment is blocked by something), and constricted (as in a predefined width clearance and/or height clearance or free ingress and/or egress of personnel and/or equipment is constricted by something). In certain embodiments, the condition may comprise a state such as blocked, clear, or constricted.

Certain shifting or changes in the mine roof, mine floor, or gate entry walls, may cause the condition of a gate entry to change as mining operations are performed. Examples of such changes include, but are not limited to floor heave, roof displacement, rib displacement, and the like.

A blocked condition may mean that something or someone is in the gate entry and positioned such that advancing a gate entry support will run into the thing or person. A clear condition may mean that nothing is positioned in the gate entry such that advancing a gate entry support will run into something. Alternatively, or in addition, a clear condition may mean that a mine roof, mine floor, and/or mine wall of the gate entry defines a predefined width clearance and/or predefined height clearance within the gate entry.

"Width clearance" refers to a measure of how much space between two walls of the gate entry should exist in order to conduct mining operations. In certain embodiments, a width clearance comprises a minimum width that the gate entry should have. In other embodiments, a width clearance comprises a maximum width that the gate entry should have. In another embodiment, a width clearance comprises a range for a width that the gate entry should have.

In certain embodiments, a width clearance includes an accommodation for other structures or machinery that may be present in the gate entry, such as wire mesh, wall support system, stage loader, transport conveyor, or the like.

"Height clearance" refers to a measure of how much space between a mine roof and a mine floor should exist in order to conduct mining operations. In certain embodiments, a height clearance comprises a minimum height that the gate entry should have. In other embodiments, a height clearance comprises a maximum height that the gate entry should have. In another embodiment, a height clearance comprises a range for a height that the gate entry should have.

In certain embodiments, a height clearance includes an accommodation for other structures or machinery that may be present in the gate entry, such as wire mesh or roof support systems.

After the controller 704 determines a condition for the gate entry 712, the controller 704 may determine whether the condition satisfies an entry condition threshold. "Entry condition threshold" refers to one or more measurements, conditions, and/or parameters that a condition for a gate entry should meet in order to permit further mining operations. In certain embodiments, an entry condition threshold defines a level or minimum value or maximum value that certain characteristics of a gate entry should satisfy to permit further mining operations. In certain embodiments, an entry condition threshold defines a level or threshold that if met, satisfied, or crossed indicates a potentially hazardous condition of the gate entry such that a production cycle should stop and/or mine personnel should be notified.

In one embodiment, if the condition satisfies the entry condition threshold, the controller 704 may signal the drive unit 706, using the communication module 718, to move, or advance, the gate entry support 700. If the condition fails to satisfy the entry condition threshold, the controller 704 may signal a halt condition for a production cycle. "Halt condition" refers to a condition or indication that a certain process, method, operation, or behavior should stop. For example, if a gate entry support signals a halt condition for a production cycle, this may mean, in one embodiment, that the production cycle should not proceed because the gate entry support has determined that there is danger or risk to personnel or equipment should the production cycle proceed or be initiated.

In certain embodiments, once a halt condition is signaled for the production cycle, the halt condition may be overridden by a production cycle operator. Prior to overriding the halt condition, the production cycle operator may review data provided by the gate entry support, interact with the gate entry support (e.g., review or direct one or more of cameras of the gate entry support or other sensors), make a visual inspect of the gate entry, initiate a real time survey of the gate entry, or take other reasonable measures to determine whether the halt condition can and/or should be overridden.

"Production cycle" refers to a cycle of a mining operation in which certain mining equipment conducts mining operations in cooperation with one or more other mining equipment to extract a mineral from a mine. The mine may be an above ground or underground mining operation. In certain embodiments, one production cycle means that the mining equipment is in a position to mine the mineral and that the mining equipment performs a sequence of steps to extract the mineral while in the position. Once mineral available to mine in the position has been removed, the mining equipment may move or may be moved to a new position in order to mine more of the mineral.

In a longwall mining operation, one production cycle may comprise setting the pan line, setting a shearer, setting the chocks of the longwall, setting a stage loader and transport conveyor, and/or setting one or more gate entry supports in a first position. Next, the production cycle may include the shearer making a single pass along the pan line from the tailgate and across a mining face to the headgate to cut away a mineral that falls into the pan line and is transported to the stage loader and transport conveyor.

In one embodiment, once the shearer makes one pass cutting the mineral from the mining face and moves from the tailgate to the headgate a production cycle is complete. The next step is to advance the pan line, shearer, chocks, stage loader, and gate entry support(s) to a new position closer to the mining face so that a subsequent production cycle may be conducted.

The controller 704 may communicate with the sensors 720 periodically, or in connection with a process for implementing a production cycle. Together the controller 704 and sensors 720 help to enable the gate entry support 700 to autonomously monitor a condition for a gate entry and re-position the gate entry support 700 during a longwall mining operation.

The drive unit 706 is preferably connected to the gate entry support 700 and may be managed and/or controlled by the controller 704. Drive unit 706 may be configured and may operate and function similar to the drive unit 206 described in relation to FIG. 2. In one embodiment, the drive unit 706 may comprise a linkage 722. A linkage 722 is one example of possible mechanisms that may serve as the drive unit 706.

In one embodiment, the linkage 722 comprises a hydraulic cylinder. "Hydraulic cylinder" refers to a mechanical actuator that is used to give a unidirectional force through a unidirectional stroke. It has many applications, notably in construction equipment (engineering vehicles), manufacturing machinery, mining engineering, and civil engineering. (listing for "hydraulic cylinder" on Wikipedia website. Oct. 21, 2019. Edited. Accessed Dec. 5, 2019.)

A hydraulic cylinder may be of a single acting type or a double acting type. Single acting cylinders are economical and the simplest design. Hydraulic fluid enters through a port at one end of the cylinder, which extends the rod by means of area difference. An external force, internal retraction spring or gravity returns the piston rod. Double acting cylinders have a port at each end or side of the piston, supplied with hydraulic fluid for both the retraction and extension. (listing for "hydraulic cylinder." on Wikipedia website. Oct. 21, 2019. Edited. Accessed Dec. 5, 2019.)

In one embodiment, the drive unit 706 moves the gate entry support 700 by coupling the linkage 722 to a stationary object such as an anchor or another gate entry support 700 that is stationary (either because of its own weight and mass or because the gate entry support 700 is applying a holding pressure to one of a mine roof 708 and/or mine floor 710. Extending the linkage 722 may push or pull the gate entry support 700 away from, or toward, the stationary object.

In one embodiment, the gate entry support 700 is physically coupled to one or more parts of a longwall 134. For example, the gate entry support 700 may be coupled by a linkage 722 to a pan line (e.g., mining face conveyor 118). In such an embodiment, the gate entry support 700 can be operated in conjunction with a longwall 134. In such an embodiment, the gate entry support 700 may be used to steer and direct a longwall 134.

In one embodiment, the gate entry support 700 operates independent of other gate entry supports 700 and/or mining equipment. In another embodiment, the gate entry support 700 operates as a master gate entry support and directs one or more servant gate entry supports.

Figure 8:
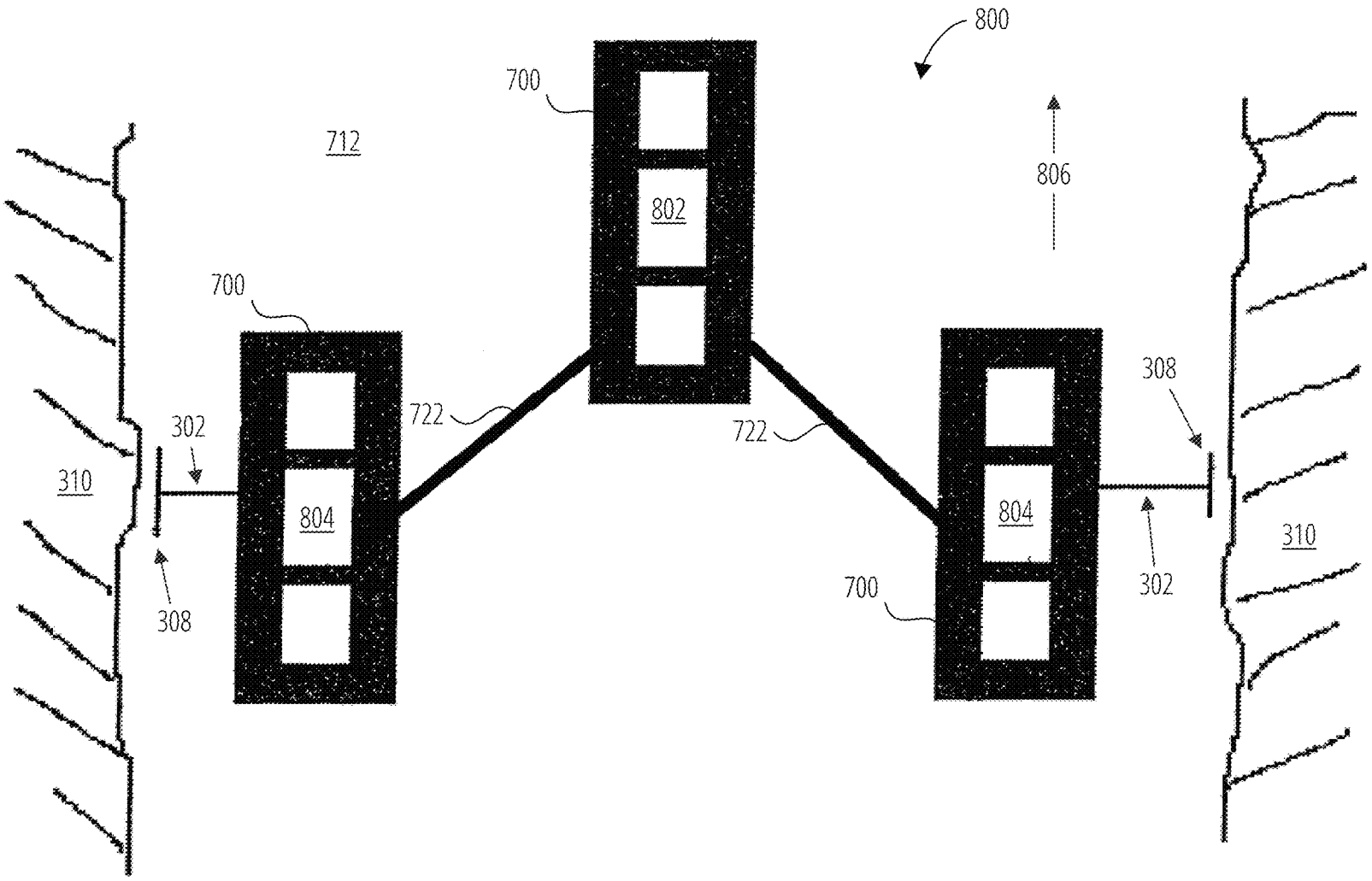
FIG. 8 is a block diagram illustrating a plurality of gate entry supports in accordance with one embodiment.

FIG. 8 illustrates an example placement patterns for positioning a plurality of gate entry supports 700 within system 800. In one embodiment, the placement pattern illustrated, may be used for gate entry supports 700 in a master servant relationship. In the example of FIG. 8, one gate entry support may serve as a master gate entry support 802. "Master gate entry support" refers to a gate entry support configured to manage itself and one or more other gate entry supports autonomously within a gate entry. In one embodiment, a master gate entry support may include lights, a power supply or a coupling to a power supply, one or more sensors for evaluating a condition of the gate entry, logic to configure and operate the gate entry support, logic configured to direct and instruct one or more servant gate entry supports to advance and engage a mine roof, mine floor, and/or walls of a gate entry, and a communication module configured to convey messages/signals between the master gate entry support and the one or more servant gate entry supports.

The other two illustrated gate entry supports may be servant gate entry supports 804. "Servant gate entry support" refers to a gate entry support configured to operate and function in response to commands and/or instructions from another gate entry support, such as, for example a master gate entry support. In one embodiment, a servant gate entry support may include lights, a power supply or a coupling to a power supply, one or more sensors for evaluating a condition of the gate entry, and a communication module configured to exchange messages/signals with a master gate entry support. In one embodiment, the servant gate entry support may include all of the features, functions, components, and capabilities of a master gate entry support but not use each of these features, functions, components, and capabilities while the servant gate entry support operates as a servant gate entry support.

The master gate entry support 802 is configured to gather entry data for a condition of the gate entry 712. The master gate entry support 802 also determines a condition of the gate entry 712. In certain embodiments, the master gate entry support 802 may determine the condition solely based on sensors 720 on board the master gate entry support 802. In other embodiments, the master gate entry support 802 may determine the condition based at least in part on one or more sensors 720 on board one or more of the servant gate entry supports 804.

After determining the condition, the master gate entry support 802 may determine whether the condition satisfies an entry condition threshold. If so, then the master gate entry support 802 may signal or direct one or more of the servant gate entry supports 804 to advance. If not, the master gate entry support 802 may signal a halt condition for a production cycle. The halt condition may be logged by the master gate entry support 802, may be communicated to a production cycle operator, and/or may be communicated to another controller such as a longwall controller.

In one embodiment, each servant gate entry support 804 includes a drive unit 706 (or shares a drive unit with another gate entry support) and a communication module. The master gate entry support 802 sends commands and may receive entry data to and from the servant gate entry supports 804 using the communication modules. The master gate entry support 802 also includes a drive unit and a communication module.

In one embodiment, two gate entry supports 700 together with a linkage 722 such as a hydraulic cylinder that couples them form a drive unit. Alternatively, each of the master gate entry support 802 and the servant gate entry supports 804 may include a drive unit. The drive unit may be signaled to activate by the master gate entry support 802. Alternatively, one of the servant gate entry supports 804 may signal the drive unit to activate.

Suppose arrow 806 (e.g., advance direction 806) indicates the direction of mining for a longwall. The two gate entry supports 700 collaborate to move in the advance direction 806 by having one gate entry support serve as an anchor while the linkage 722 is extended or retracted and then the other gate entry support serves as an anchor and the linkage 722 is retracted or extended to move the non-stationary gate entry support. In this manner, two gate entry supports may "walk" down the gate entry 712.

In FIG. 8, master gate entry support 802 may signal the servant gate entry supports 804 to maintain a holding pressure against a mine roof and mine floor. Next, the master gate entry support 802 may signal the linkage 722 to extend to push the master gate entry support 802 in the advance direction 806. Next, the master gate entry support 802 may establish a holding pressure against the mine roof and mine floor and may signal the linkage 722 to retract and pull one of the servant gate entry supports 804 in the advance direction 806. Both servant gate entry supports 804 may advance concurrently, or in a sequence.

In one embodiment, the master gate entry support 802 (or another embodiment of a gate entry support) may gather entry data by monitoring seismic activity within the gate entry 712 using a seismic sensor. In certain embodiments, in response to the monitored seismic activity, the master gate entry support 802 may make an adjustment to one or more aspects of the system 800. For example, in response to monitored seismic activity, the master gate entry support 802 may change or adjust a holding pressure applied by one or more of the servant gate entry supports 804 and/or the master gate entry support 802. It should be noted that the seismic activity may increase or may decrease. Consequently, a controller of a gate entry support may be configured to adjust the holding pressure (e.g., either increasing or decreasing) depending on how the seismic activity is changing. For example, if the seismic activity is increasing, in one embodiment, the gate entry support may increase the holding pressure.

In another example, in response to monitored seismic activity, the master gate entry support 802 may change or adjust a configuration (e.g., placement pattern) of one or more of the servant gate entry supports 804 and/or the master gate entry support 802 within the gate entry 712. Changing the placement pattern may include changing a position of each of the servant gate entry supports 804 and/or the master gate entry support 802 relative to each other and/or relative to one or more gate entry walls 310. Such a change in position may include changing a distance between one or more gate entry supports in the system 800.

Advantageously, the ability of the master gate entry support 802 and servant gate entry supports 804 to change their placement pattern configuration and/or holding pressure enables the system 800 to adapt to changing conditions within the gate entry 712. For example, if there is less over burden, the system 800 may reduce a holding pressure. Similarly, if there is more over burden for a certain stretch within the gate entry 712, the system 800 may increase the holding pressure. In one embodiment, changing the placement pattern may include changing a position of gate entry supports relative to each other (alignment or position) as well as adjusting the amount of space/distance between gate entry supports.

Furthermore, the autonomous functions of the master gate entry support 802 may enable automatic adaptation to changing conditions in the gate entry 712. For example, if a sensor 720 detects a deformation of a gate entry wall 310 and this is indicated in the entry data, the master gate entry support 802 may signal one or more gate entry supports such as servant gate entry supports 804 to extend one or more lateral extension members 302 and engage one or more gate entry walls 310 using the side plates 308.

Those of skill in the art will recognize that various other placement patterns may be used with the claimed solution. All such placement patterns are considered within the scope of the claimed solution.

Figure 9:
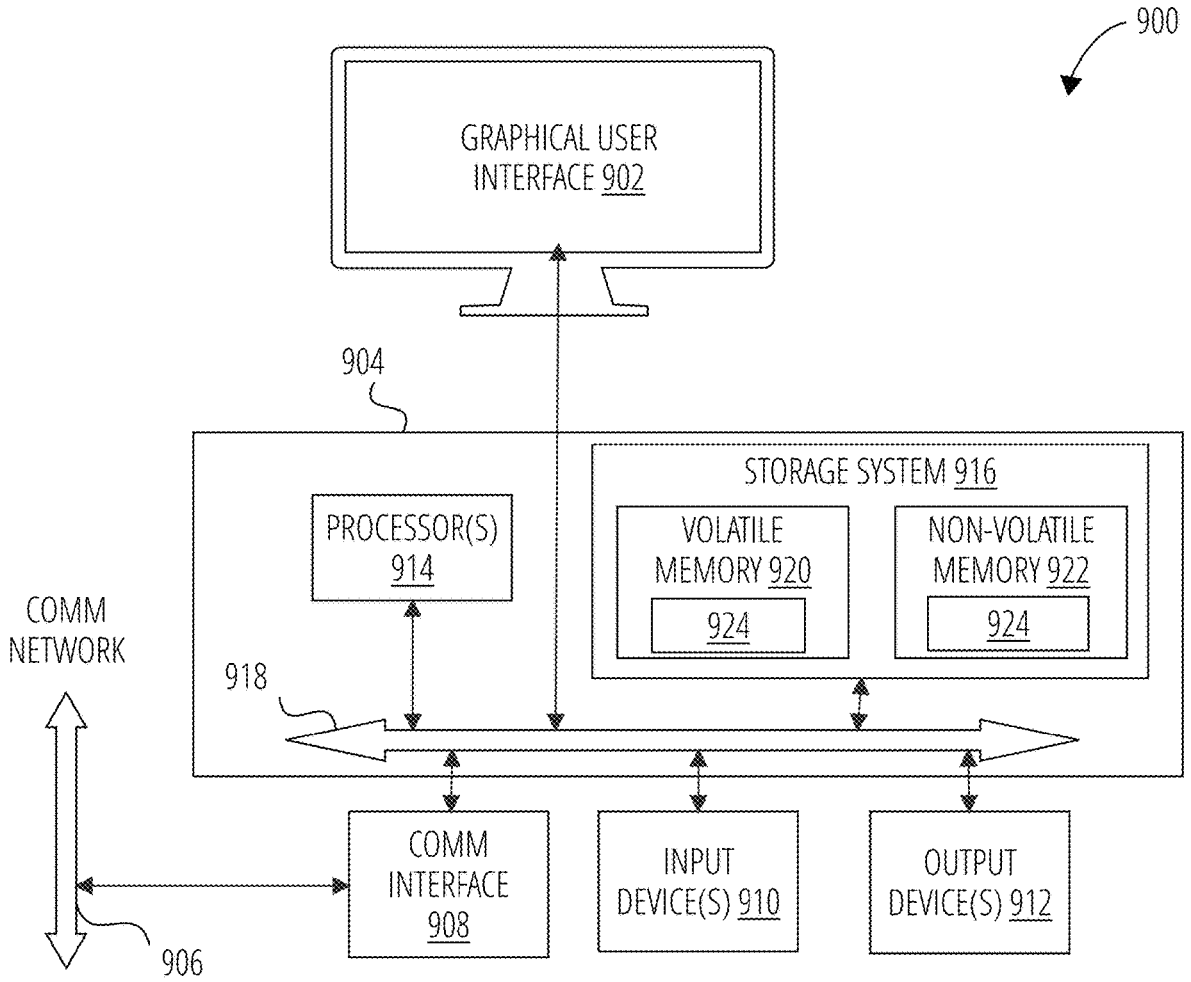
FIG. 9 is an example block diagram of a controller 900 that may be used in one embodiment.

FIG. 9 is an example block diagram of a controller 900 that may incorporate embodiments of the claimed solution. FIG. 9 is merely illustrative of a machine system to carry out aspects of the technical processes described herein, and does not limit the scope of the claims. One of ordinary skill in the art would recognize other variations, modifications, and alternatives. In certain embodiments, the controller 900 includes a graphical user interface 902, a data processing system 904, a communication network 906, communication network interface 908, input device(s) 910, output device(s) 912, and the like.

As depicted in FIG. 9, the data processing system 904 may include one or more processor(s) 914 and a storage system 916. "Processor" refers to any circuitry, component, chip, die, package, or module configured to receive, interpret, decode, and execute machine instructions. Examples of a processor may include, but are not limited to, a central processing unit, a general-purpose processor, an application-specific processor, a graphics processing unit (GPU), a field programmable gate array (FPGA), application Specific Integrated Circuit (ASIC), System on a Chip (SoC), virtual processor, processor core, and the like. The processor(s) 914 communicate with a number of peripheral devices via a bus subsystem 918. These peripheral devices may include input device(s) 910, output device(s) 912, communication network interface 908, and the storage system 916. The storage system 916, In one embodiment, comprises one or more storage devices and/or one or more memory devices. The term "storage device" refers to any hardware, system, subsystem, circuit, component, module, non-volatile memory media, hard disk drive, storage array, device, or apparatus configured, programmed, designed, or engineered to store data for a period of time and retain the data in the storage device while the storage device is not using power from a power supply. Examples of storage devices include, but are not limited to, a hard disk drive, FLASH memory, MRAM memory, a Solid-State storage device, Just a Bunch Of Disks (JBOD), Just a Bunch Of Flash (JBOF), an external hard disk, an internal hard disk, and the like.

In one embodiment, the storage system 916 includes a volatile memory 920 and a non-volatile memory 922. The term "volatile memory" refers to a shorthand name for volatile memory media. In certain embodiments, volatile memory refers to the volatile memory media and the logic, controllers, processor(s), state machine(s), and/or other periphery circuits that manage the volatile memory media and provide access to the volatile memory media. The term "non-volatile memory" refers to shorthand name for non-volatile memory media. In certain embodiments, non-volatile memory media refers to the non-volatile memory media and the logic, controllers, processor(s), state machine(s), and/or other periphery circuits that manage the non-volatile memory media and provide access to the non-volatile memory media. The volatile memory 920 and/or the non-volatile memory 922 may store computer-executable instructions that alone or together form logic 924 that when applied to, and executed by, the processor(s) 914 implement embodiments of the processes disclosed herein. The term "logic" refers to machine memory circuits, non-transitory machine readable media, and/or circuitry which by way of its material and/or material-energy configuration comprises control and/or procedural signals, and/or settings and values (such as resistance, impedance, capacitance, inductance, current/voltage ratings, etc.), that may be applied to influence the operation of a device. Magnetic media, electronic circuits, electrical and optical memory (both volatile and nonvolatile), and firmware are examples of logic. Logic specifically excludes pure signals or software per se (however does not exclude machine memories comprising software and thereby forming configurations of matter).

"Memory" refers to any hardware, circuit, component, module, logic, device, or apparatus configured, programmed, designed, arranged, or engineered to retain data. Certain types of memory require availability of a constant power source to store and retain the data. Other types of memory retain and/or store the data when a power source is unavailable.

"Volatile memory media" refers to any hardware, device, component, element, or circuit configured to maintain an alterable physical characteristic used to represent a binary value of zero or one for which the alterable physical characteristic reverts to a default state that no longer represents the binary value when a primary power source is removed or unless a primary power source is used to refresh the represented binary value. Examples of volatile memory media include but are not limited to dynamic random-access memory (DRAM), static random-access memory (SRAM), double data rate random-access memory (DDR RAM) or other random-access solid-state memory While the volatile memory media is referred to herein as "memory media," in various embodiments, the volatile memory media may more generally be referred to as volatile memory.

In certain embodiments, data stored in volatile memory media is addressable at a byte level which means that the data in the volatile memory media is organized into bytes (8 bits) of data that each have a unique address, such as a logical address.

"Computer" refers to any computing device. Examples of a computer include, but are not limited to, a personal computer, a laptop, a tablet, a desktop, a server, a main frame, a super computer, a computing node, a virtual computer, a hand held device, a smart phone, a cell phone, a system on a chip, a single chip computer, and the like.

"File" refers to a unitary package for storing, retrieving, and communicating data and/or instructions. A file is distinguished from other types of packaging by having associated management metadata utilized by the operating system to identify, characterize, and access the file.

"Module" refers to a computer code section having defined entry and exit points. Examples of modules are any software comprising an application programming interface, drivers, libraries, functions, and subroutines.

"Hardware" refers to logic embodied as analog and/or digital circuitry.

"Instructions" refers to symbols representing commands for execution by a device using a processor, microprocessor, controller, interpreter, or other programmable logic. Broadly, 'instructions' can mean source code, object code, and executable code. 'instructions' herein is also meant to include commands embodied in programmable read-only memories (EPROM) or hard coded into hardware (e.g., 'micro-code') and like implementations wherein the instructions are configured into a machine memory or other hardware component at manufacturing time of a device.

"Operating system" refers to Logic, typically software, that supports a device's basic functions, such as scheduling tasks, managing files, executing applications, and interacting with peripheral devices. In normal parlance, an application is said to execute "above" the operating system, meaning that the operating system is necessary in order to load and execute the application and the application relies on modules of the operating system in most cases, not vice-versa. The operating system also typically intermediates between applications and drivers. Drivers are said to execute "below" the operating system because they intermediate between the operating system and hardware components or peripheral devices.

"Software" refers to logic implemented as instructions for controlling a programmable device or component of a device (e.g., a programmable processor, controller). Software can be source code, object code, executable code, machine language code. Unless otherwise indicated by context, software shall be understood to mean the embodiment of said code in a machine memory or hardware component, including "firmware" and micro-code. "Application" refers to any software that is executed on a device above a level of the operating system. An application will typically be loaded by the operating system for execution and will make function calls to the operating system for lower-level services. An application often has a user interface, but this is not always the case. Therefore, the term 'application' includes background processes that execute at a higher level than the operating system.

The input device(s) 910 include devices and mechanisms for inputting information to the data processing system 904. These may include a keyboard, a keypad, a touch screen incorporated into the graphical user interface 902, audio input devices such as voice recognition systems, microphones, and other types of input devices. In various embodiments, the input device(s) 910 may be embodied as a computer mouse, a trackball, a track pad, a joystick, wireless remote, drawing tablet, voice command system, eye tracking system, and the like. The input device(s) 910 typically allow a user to select objects, icons, control areas, text and the like that appear on the graphical user interface 902 via a command such as a click of a button or the like.

The output device(s) 912 include devices and mechanisms for outputting information from the data processing system 904. These may include the graphical user interface 902, speakers, printers, infrared LEDs, and so on, as well understood in the art. In certain embodiments, the graphical user interface 902 is coupled to the bus subsystem 918 directly by way of a wired connection. In other embodiments, the graphical user interface 902 couples to the data processing system 904 by way of the communication network interface 908. For example, the graphical user interface 902 may comprise a command line interface on a separate controller 900 such as desktop, server, or mobile device.

The communication network interface 908 provides an interface to communication networks (e.g., communication network 906) and devices external to the data processing system 904. The communication network interface 908 may serve as an interface for receiving data from and transmitting data to other systems. Embodiments of the communication network interface 908 may include an Ethernet interface, a modem (telephone, satellite, cable, ISDN), (asynchronous) digital subscriber line (DSL), FireWire, USB, a wireless communication interface such as Bluetooth or WiFi, a near field communication wireless interface, a cellular interface, and the like.

The communication network interface 908 may be coupled to the communication network 906 via an antenna, a cable, or the like. In some embodiments, the communication network interface 908 may be physically integrated on a circuit board of the data processing system 904, or in some cases may be implemented in software or firmware, such as "soft modems", or the like.

The controller 900 may include logic that enables communications over a network using protocols such as HTTP, TCP/IP, RTP/RTSP, IPX, UDP and the like.

The volatile memory 920 and the non-volatile memory 922 are examples of tangible media configured to store computer readable data and instructions to implement various embodiments of the processes described herein. Other types of tangible media include removable memory (e.g., pluggable USB memory devices, mobile device SIM cards), optical storage media such as CD-ROMS, DVDs, semiconductor memories such as flash memories, non-transitory read-only-memories (ROMS), battery-backed volatile memories, networked storage devices, and the like. The volatile memory 920 and the non-volatile memory 922 may be configured to store the basic programming and data constructs that provide the functionality of the disclosed processes and other embodiments thereof that fall within the scope of the claimed solution.

Logic 924 that implements one or more parts of embodiments of the solution may be stored in the volatile memory 920 and/or the non-volatile memory 922. Logic 924 may be read from the volatile memory 920 and/or non-volatile memory 922 and executed by the processor(s) 914. The volatile memory 920 and the non-volatile memory 922 may also provide a repository for storing data used by the logic 924.

The volatile memory 920 and the non-volatile memory 922 may include a number of memories including a main random-access memory (RAM) for storage of instructions and data during program execution and a read only memory (ROM) in which read-only non-transitory instructions are stored. The volatile memory 920 and the non-volatile memory 922 may include a file storage subsystem providing persistent (non-volatile) storage for program and data files. The volatile memory 920 and the non-volatile memory 922 may include removable storage systems, such as removable flash memory.

The bus subsystem 918 provides a mechanism for enabling the various components and subsystems of data processing system 904 communicate with each other as intended. Although the communication network interface 908 is depicted schematically as a single bus, some embodiments of the bus subsystem 918 may utilize multiple distinct busses.

It will be readily apparent to one of ordinary skill in the art that the controller 900 may be a device such as a smartphone, a desktop computer, a laptop computer, a rack-mounted computer system, a computer server, or a tablet computer device. As commonly known in the art, the controller 900 may be implemented as a collection of multiple networked computing devices. Further, the controller 900 will typically include operating system logic (not illustrated) the types and nature of which are well known in the art.

Terms used herein should be accorded their ordinary meaning in the relevant arts, or the meaning indicated by their use in context, but if an express definition is provided, that meaning controls.

Figure 10:
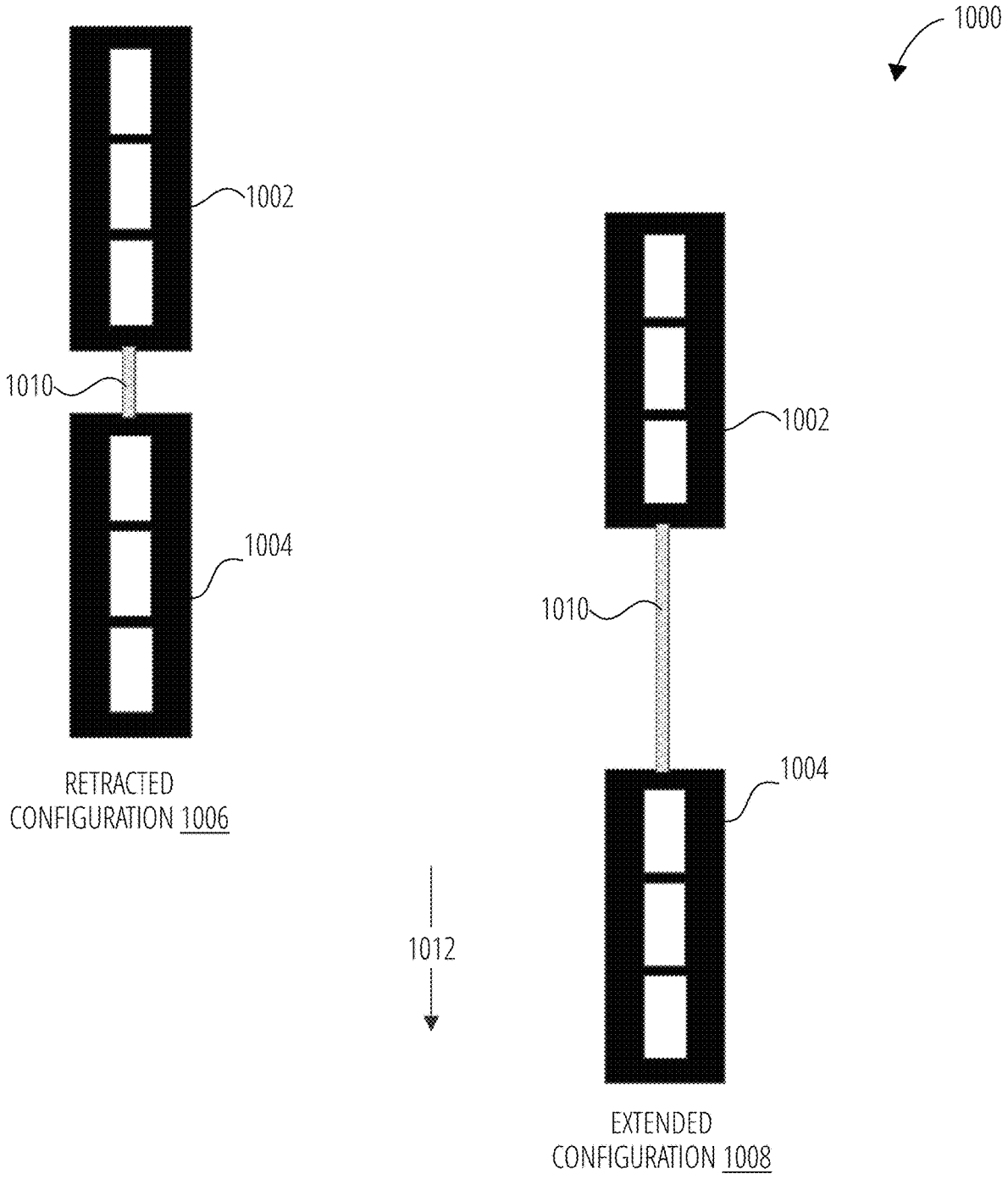
FIG. 10 is a block diagram illustrating a pair of gate entry supports in retracted and extended configurations.

FIG. 10 illustrates a plan view of two pairs of gate entry support configured to cooperate to walk in an advance direction 806. The gate entry supports may be working as peers or working in a master/servant configuration. A first gate entry support 1002 is coupled to a second gate entry support 1004 by a drive unit 1010.

In a first configuration, the drive unit 1010 is in a retracted configuration 1006. In an embodiment in which the drive unit comprises a hydraulic cylinder, the hydraulic cylinder may be retracted. In the retracted configuration 1006 both the first gate entry support 1002 and the second gate entry support 1004 may engage the mine roof and mine floor and apply a holding pressure.

In order to advance the second gate entry support 1004 in the advance direction 1012, the first gate entry support 1002 may maintain a holding pressure against the mine roof and mine floor and thereby serve as an anchor and the second gate entry support 1004 may release a holding pressure. The drive unit 1010 may extend and push the second gate entry support 1004 in the advance direction 1012. By repeating this process, between a retracted configuration 1006 and an extended configuration 1008 the two gate entry supports walk within a gate entry. Once the first gate entry support 1002 and second gate entry support 1004 move to the extended configuration 1008, the roles of anchor may reverse. The second gate entry support 1004 may establish a holding pressure and the first gate entry support 1002 may release the holding pressure. Next, the drive unit 1010 may be retracted such that the first gate entry support 1002 is pulled toward the second gate entry support 1004 to advance in the advance direction 1012. Of course, the process of extension and retraction may be reversed to move the first gate entry support 1002 and second gate entry support 1004 in the opposite direction.

Figure 11:
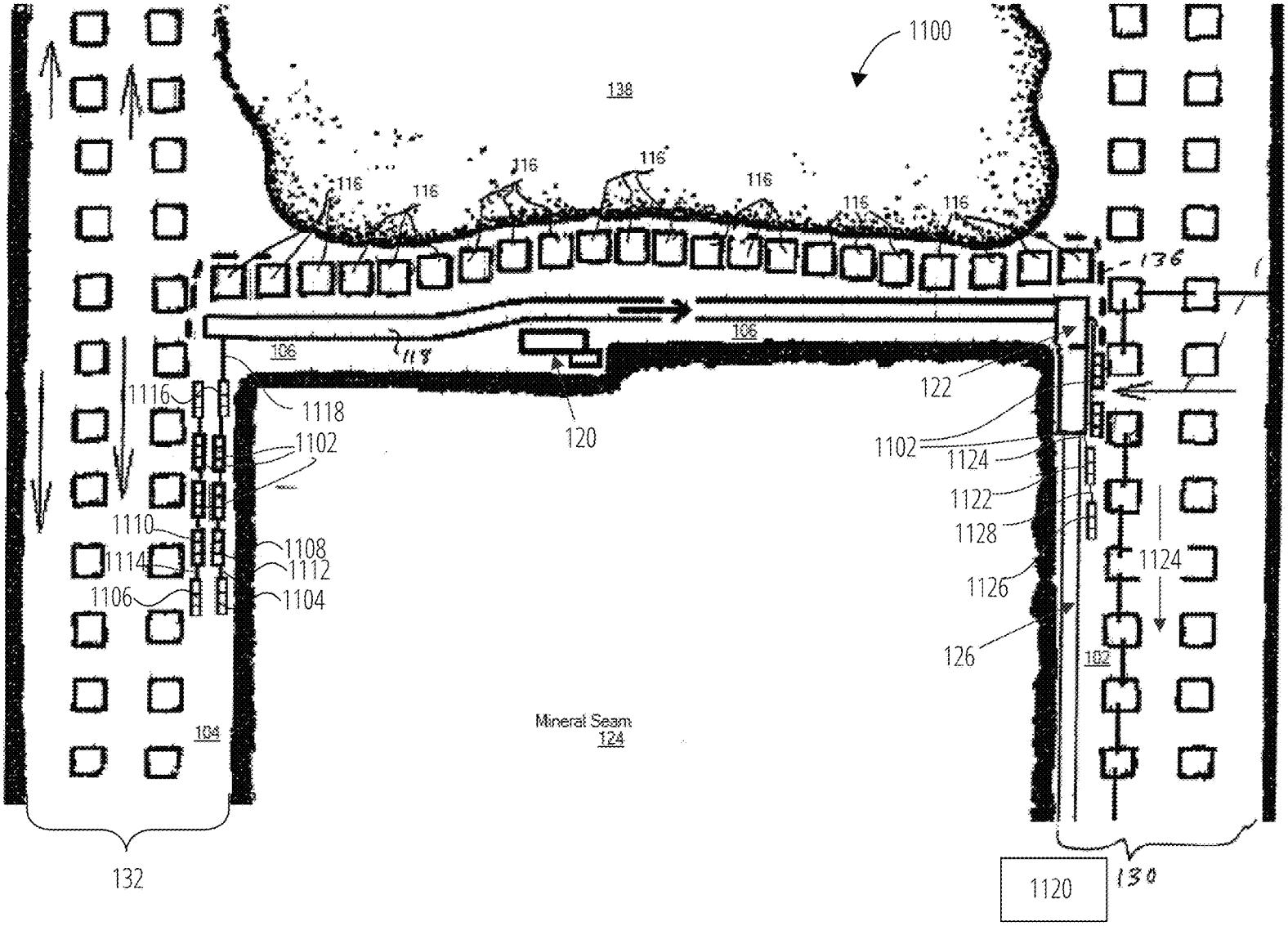
FIG. 11 is a schematic block diagram illustrating a mining layout for supporting system 1100 in accordance with one embodiment.

FIG. 11 illustrates one embodiment of a mining layout for a system 400. The system 1100 includes a first gate entry support 1104 within a tailgate 132, a second gate entry support 1106 within the tailgate 132 and parallel with the first gate entry support 1104. The system 1100 also includes a third gate entry support 1108 within the tailgate 132, the third gate entry support 1108 positioned behind the first gate entry support 1104, and a fourth gate entry support 1110, also within the tailgate 132 and positioned behind the second gate entry support 1106. In one embodiment, the first gate entry support 1104 is coupled to the third gate entry support 1108 by a first linkage 1112. The second gate entry support 1106 is coupled to the fourth gate entry support 1110 by a second linkage 1114.

The system 1100 includes a pan line 118 positioned in front of a mining face 106, a shearer 120 coupled to the pan line 118. The shearer 120 is configured to travel across the mining face 106. The system 1100 also includes a stage loader 122 coupled to the pan line 118 and configured to receive mined mineral and transport the mined mineral to a transport conveyor 126. The system 1100 includes a plurality of chocks 116 positioned behind the pan line 118 such that the pan line 118 is positioned between the plurality of chocks 116 and the mining face 106.

The system 1100 is configured such that one or more of the first gate entry support, the second gate entry support, the third gate entry support, and the fourth gate entry support monitor a condition of the tailgate 132 and advance within the tailgate 132 in response to the condition satisfying an entry condition threshold. It should be noted that while one embodiment of the system 1100 may include four gate entry supports, the illustrated example in FIG. 11 includes as many as ten gate entry supports in the tailgate 132. The number and configuration of gate entry supports used may vary depending on the mining conditions and other factors.

The system 1100 of FIG. 11 may include a longwall controller 1120 and a gate entry support 1116 coupled to the pan line 118 by a third linkage 1118. With this configuration, when the gate entry support 1116 has advanced to a new position and re-established a holding pressure, one or more of a gate entry support 1116, a master gate entry support, a longwall controller, or other controller may activate the third linkage 1118 to move the pan line 118 closer to, or even abutting the mining face 106. The longwall controller 1120 may control a position of the gate entry support 1116 and/or manage the third linkage 1118 so as to steer the pan line 113 relative to the mining face 106.

FIG. 11 illustrates the longwall controller 1120 outside the mine layout because the longwall controller 1120 may be positioned in a variety of locations with respect to the tailgate 132, headgate 130, and the various components that make up a longwall operation. In one embodiment, the longwall controller 1120 is coupled to other equipment of the longwall by a cable and the longwall controller 1120 sits within a control or operations room located at another place in the mine. In another embodiment, the longwall controller 1120 is coupled to other equipment of the longwall by a wired or wireless connection and the longwall controller 1120 sits in a location on the surface outside the mine. In another embodiment, the longwall controller 1120 is coupled to other equipment of the longwall by a wired or wireless connection and the longwall controller 1120 is positioned on or near the stage loader 122.

In certain embodiments, the system 1100 includes a fifth gate entry support 1122 coupled to the stage loader 122 by a first hydraulic cylinder 1124 and sixth gate entry support 1126 coupled to the fifth gate entry support 1122 by a second hydraulic cylinder 1128. The fifth gate entry support 1122 and sixth gate entry support 1126 are positioned within the headgate 130. In such a configuration, the sixth gate entry support 1126 may move in advancement direction 1126 by activating the second hydraulic cylinder 1128 and pushing the sixth gate entry support 1126 forward by pushing against the fifth gate entry support 1122.

After the sixth gate entry support 1126 moves forward, the sixth gate entry support 1126 may establish a holding pressure and the fifth gate entry support 1122 may activate the second hydraulic cylinder to pull the fifth gate entry support 1122 toward the sixth gate entry support 1126. Next, both the fifth gate entry support 1122 and sixth gate entry support 1126 may establish a holding pressure and the fifth gate entry support 1122 may activate the first hydraulic cylinder to pull the stage loader 122 toward the fifth gate entry support 1122. In this manner, movement of gate entry supports may be used to move components of a longwall mining system in both a headgate 130 and a tailgate 132.

In one embodiment, the system 1100 may assist in keeping the mining face conveyor 118 aligned with a stage loader 122 or transport conveyor 126. In one embodiment, the gate entry supports 1100 may pull the mining face conveyor forward. Given the conditions in the mine (e.g., water, mud, uneven ground, etc.) pulling of the mining face conveyor may be more effective than pushing from behind off of the chocks 116. In addition, by accurately positioning one or more gate entry supports within the gate entries and coupling them to the pan line, an automated longwall operation may be conducted that steers the pan line and may keep the longwall centered as it advances along an engineered course.

Alternatively, the system 1100 may not provide alignment or movement assistance. Consequently, the gate entry supports 1102 provide flexibility in providing support where needed. The gate entry supports 1102 can be operated and moved independent of the operation and movement of the mining face conveyor 118 or other longwall equipment.

Positioning of the gate entry supports 1102 may also include positioning of support cabling and support hoses for extraction mining equipment. Preferably, the support cabling and support hoses are positioned within the access passage. The gate entry supports 1102 prevent cave ins such as wall, floor, or roof failures that may cover or damage the support cabling and support hoses.

As full extraction mining shortens the gate entries 102, 104 and the gate entry supports 1102 begin to enter the mining face 106, the controller 204 may operate autonomously to reposition the gate entry supports 1102 further down along the length of the gate entries 102, 104. The gate entry supports 1102 may advance using contact advance or non-contact advance. Repositioning of the gate entry supports 1102 allows for reuse of the gate entry supports 1102 during full extraction mining operations.

The schematic flow chart diagram(s) included is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 12:
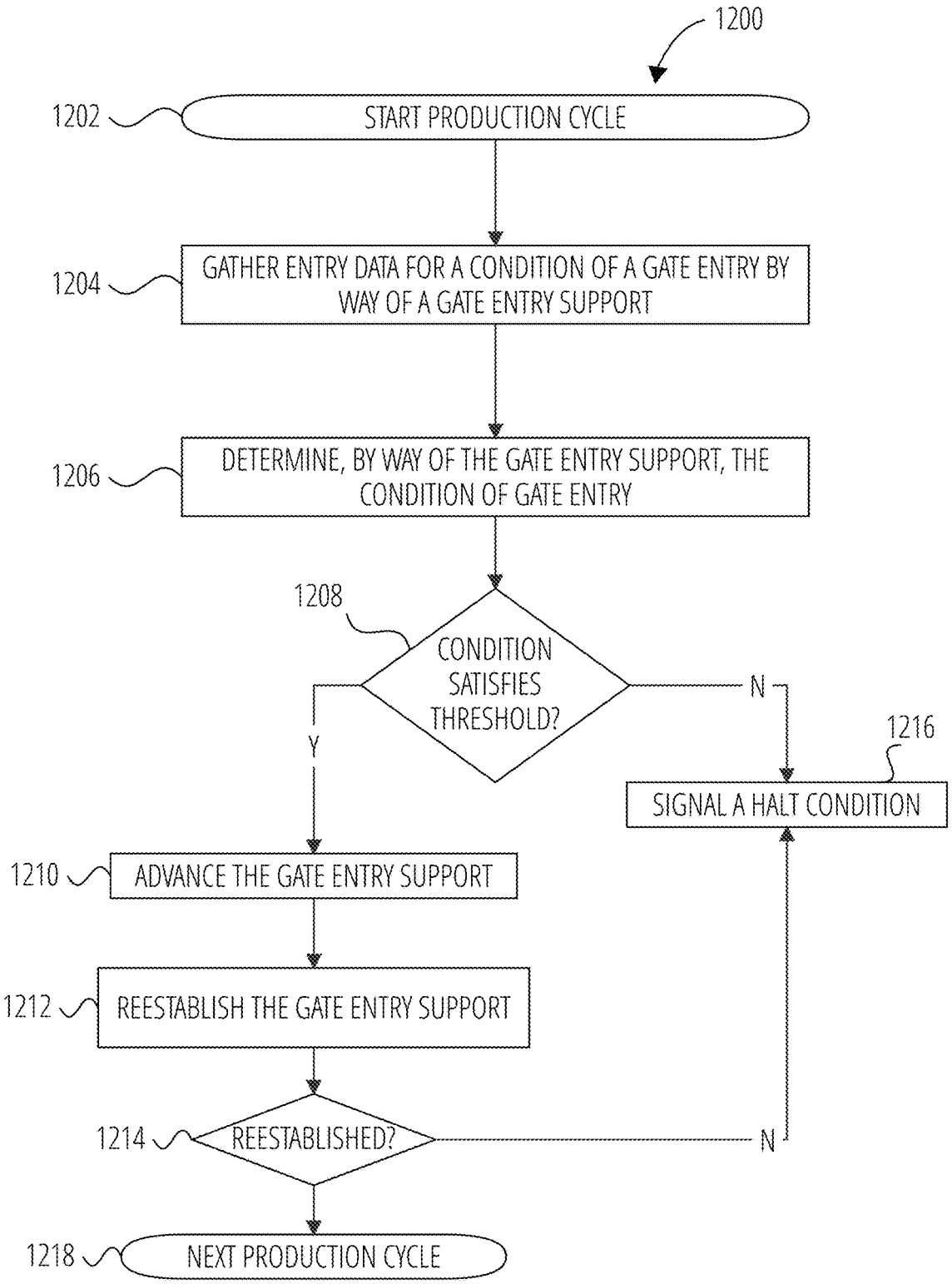
FIG. 12 illustrates a method 1200 in accordance with one embodiment.

FIG. 12 illustrates a method 1200 for automated support of a gate entry for underground full extraction mining. The method 1200 begins 1202 with the start of a production cycle. In one embodiment, the method 1200 includes making a determination as to whether or not a production cycle can be started. For example, certain conditions of machines or equipment within the gate entries or across a mining face may need to be met before a production cycle may be started. In other embodiments, a gate entry support may await a signal or message from another controller, such as a longwall controller, from an operator, or the like before a production cycle may be started.

Next, a controller gathers 1204 entry data in relation to a condition of a gate entry. In certain embodiments, the controller may gather entry data from sensors of a gate entry support and/or from other sensors such as, for example, those of other gate entry supports.

In one embodiment, the gathering 1204 of the entry data may include conducting a real time survey of the gate entry and comparing the real time survey to a prior survey stored by the gate entry support based on a current position of the gate entry support. "Survey" refers to a measurement of certain characteristics and features of an item such as a gate entry. In one embodiment, a survey may include a measure of a width of the gate entry, a measure of a height of the gate entry, and/or a measure of a length of the gate entry out to at least some acceptable distance along the gate entry.

"Real time survey" refers to a measure of at least one position and at least one distance conducted in real time. A real time survey is a type of survey. In one embodiment, a real time survey comprises a measure of the height and width of a gate entry. In addition, a real time survey may include a measure of a position of a gate entry support within the gate entry. Those of skill in the art will appreciate that the gate entry support may include a variety of equipment for conducting a real time survey.

For example, in one embodiment, the gate entry support includes a CSIRO EXScan 3D laser available from Commonwealth Scientific and Industrial Research Organisation (CSIRO) of Australia. In another embodiment, the gate entry support includes a Carlson Void Scanner+ available from Carlson Software of Maysville, Ky., USA for conducting a real time survey.

"Prior survey" refers to a survey of a gate entry conducted in the past. A real time survey is a type of survey. A prior survey may comprise a survey conducted by personnel when a gate entry is initially formed, or a prior survey may comprise a survey conducted by a gate entry support at an earlier point in time. In certain embodiments, a prior survey includes the same parameters and/or measurements as a real time survey such that the two may be readily compared.

The prior survey may be stored for example in the storage system 916 of a controller. By comparing a prior survey to a real time survey the controller may detect changes to a condition of the gate entry caused by shifts in loading above the mine. Certain shifts or changes may be acceptable and satisfy an entry condition threshold, others may not me and may justify a halt condition.

Then, the controller determines 1206 the condition of the gate entry. In one embodiment, determining the condition of the gate entry may include one or more of comparing a real time survey of the gate entry to a prior survey of the gate entry, the prior survey stored by the gate entry support, checking for obstacles in the gate entry, determining a present height clearance, and determining a present width clearance.

Next, the controller makes a determination 1208, whether condition satisfies an entry condition threshold or not. If the gate entry condition satisfies an entry condition threshold, then the controller advances 1210 one or more gate entry supports within the gate entry. In one embodiment, advancing the gate entry support may include aligning the gate entry support within the gate entry. Alignment within the gate entry may facilitate maintaining proper access passages, ventilation flow, and active support of the mine roof and mine floor. In one embodiment, alignment within the gate entry may be required before advancing the gate entry. In another embodiment, a manner of advancing the gate entry may be used such that the gate entry is aligned once the gate entry has advanced. In certain embodiments, advancing the gate entry includes moving the gate entry support forward an advancement distance.

"Advancement distance" refers to a distance measured in some unit of measure such as feet or meters that a gate entry is configured to advance after completion of a production cycle. In one embodiment, the advancement distance is a fixed amount. In another embodiment, the advancement distance is configurable and may be changed by the gate entry support itself, by an operator, by a longwall controller, and/or based on a programmed waypoint within the gate entry. In certain embodiments, the waypoint may be correlated with a survey and the gate entry support is configured to automatically change the advancement distance once the waypoint is reached. In certain embodiments, the advancement distance may be about three feet (1 meter)

If the gate entry condition does not satisfy an entry condition threshold, then the controller signals 1216 a halt condition.

In one embodiment, once a halt condition is signaled the method 1200 may further comprise an override of the halt condition by a production cycle operator. "Production cycle operator" refers to a person, machine, or logic configured to manage and oversee a production cycle. If the production cycle operator is a person, they may be positioned in a location remote from the gate entry, gate entry support, and/or other mining equipment. For example, in one embodiment, signaling a halt condition may include sensing a message to a production cycle operator. The message may include certain readings of entry data gathered by a gate entry support. In one embodiment, the message includes a video or still camera image of the gate entry such that the production cycle operator may review the condition of the gate entry. In certain embodiments, signaling the halt condition may include a production cycle operator overriding the halt condition based on a judgement by the production cycle operator.

After one or more of the gate entry supports advance, the controller may re-establish the gate entry support. In one embodiment, this means that the controller may activate one or more support members 202 to engage a mine roof and/or mine floor. In one embodiment, a controller may reestablish the gate entry support within the gate entry by activating a hydraulic support member. In one embodiment, if the gate entry support is successfully re-established (e.g., a holding pressure force is re-established) then the controller may signal a clearance condition for a production cycle. After signaling the clearance condition, the method 1200 may proceed to a next production cycle 1218.

"Clearance condition" refers to a condition or indication that a certain event, condition, or activity is permissible. For example, if a gate entry support signals a clearance condition for a production cycle, this may mean, in one embodiment, that the production cycle can proceed with minimal danger or risk of failure or damage due to any problems with a gate entry that the gate entry support is operating within.

After the gate entry support is re-established, or at least an attempt is made to re-establish the gate entry support, the controller may determine 1214 whether the gate entry support was successfully re-established. If so, then the method 1200 proceeds to the next production cycle 1218. If not, then an error condition exists and the controller signals 1216 a halt condition.

"Error condition" refers to a state in which a gate entry support identifies or experiences an error in reestablishing the gate entry support within a gate entry. For example, if a gate entry support advances certain parts of the gate entry support may not be engaging a mine roof, mine floor, and/or mine wall of the gate entry. After the gate entry support advances, the gate entry support may signal a hydraulic support member of the gate entry support to engage a mine roof and/or mine floor.

This engagement may be referred to herein as "reestablishing" the gate entry support because the extension of the hydraulic support member causes the gate entry support to apply a holding pressure to the mine roof and/or mine floor. Similarly, the gate entry support may be reestablished with respect to the mine wall of the gate entry.

In situations, in which the gate entry support experiences a failure when reestablishing the gate entry support, such a failure may trigger an error condition. In certain embodiments, when a gate entry support experiences this error condition, the gate entry support may signal a halt condition for the production cycle.

The claimed solution may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method comprising:

gathering entry data for a condition of a gate entry by way of a gate entry support;

determining, by way of the gate entry support, the condition of the gate entry;

advancing the gate entry support, by way of a drive unit of the gate entry support, in response to the gate entry support determining that the condition satisfies an entry condition threshold;

signaling a halt condition for a production cycle, in response to determining that the condition fails to satisfy the entry condition threshold; and wherein the production cycle comprises a cycle of a mining operation in which mining equipment extracts a mineral in cooperation with the gate entry support.

2. The method of claim 1, wherein advancing the gate entry support further comprises:

reestablishing the gate entry support within the gate entry by way of activating a hydraulic support member;

signaling a clearance condition for the production cycle, in response to reestablishment of the gate entry support within the gate entry; and signaling a halt condition for the production cycle, in response to an error condition in reestablishing the gate entry support within the gate entry.

3. The method of claim 1, wherein signaling the halt condition for the production cycle further comprises overriding the halt condition by a production cycle operator.

4. The method of claim 1, wherein gathering entry data comprises:

monitoring seismic activity within the gate entry; and responding to monitored seismic activity, the responding to monitored seismic activity comprising one of adjusting a holding pressure of the gate entry support and changing a configuration of one or more gate entry supports within the gate entry.

5. The method of claim 1, wherein gathering entry data comprises:

conducting a real time survey of the gate entry;

comparing the real time survey to a prior survey stored by the gate entry support based on a current position of the gate entry support.

6. The method of claim 1, wherein advancing the gate entry support comprises aligning the gate entry support within the gate entry and moving the gate entry support forward an advancement distance in response to the gate entry support being aligned.

7. The method of claim 1, further comprising determining to start a production cycle.

8. The method of claim 1, wherein determining the condition of the gate entry comprises:

comparing a real time survey of the gate entry to a prior survey of the gate entry, the prior survey stored by the gate entry support;

checking for obstacles in the gate entry;

determining a present height clearance; and determining a present width clearance.

9. A system comprising:

a master gate entry support comprising a master drive unit configured to move the master gate entry support within the gate entry;

at least two servant gate entry supports configured to move in response to commands from the master gate entry support, each servant gate entry support comprising a servant drive unit configured to move the servant gate entry support within the gate entry; and wherein the master gate entry support is configured to:

gather entry data for a condition of the gate entry;

determine the condition of the gate entry;

advance one of the one or more of the servant gate entry supports and the master gate entry support in response to determining that the condition satisfies an entry condition threshold; and signaling a halt condition for a production cycle, in response determining that the condition fails to satisfy the entry condition threshold.

10. The system of claim 9, wherein the master gate entry support and the at least two servant gate entry supports each comprise a lateral extension member configured to engage at least one wall of the gate entry with a side plate and wherein the master gate entry support is configured to signal one or more of the lateral extension members of the master gate entry support and the at least two servant gate entry supports to extend in response to the entry data indicating deformation of a wall of the gate entry.

11. The system of claim 9, wherein the master gate entry support comprises:

a sensor configured to gather entry data;

a communication module configured to communicate with one of the at least two servant gate entry supports and with a longwall controller;

a controller coupled to the master drive unit and the sensor, the controller configured to:

receive entry data from the sensor;

determine the condition of the gate entry based on the entry data; and signal the master drive unit, by way of the communication module, to move the master gate entry support and to move the at least two servant gate entry supports in response to determining that the condition satisfies the entry condition threshold.

12. The system of claim 11, wherein the sensor comprises a seismic sensor and the controller is configured to configure one or more of a holding pressure, a position, and spacing between each of the master gate entry support and the at least two servant gate entry supports.

13. The system of claim 11, wherein the master gate entry support further comprises a plurality of sensors the plurality of sensors comprising a holding pressure sensor, a seismic sensor, a camera, a 3D laser scanner, an air quality sensor, a position sensor, a LIDAR sensor, and an egress sensor.

14. The system of claim 9, wherein each servant drive unit is configured to move a respective servant gate entry support in response to a signal from the master gate entry support and the communication module is configured to exchange signals with a communication module of another gate entry support.

15. The system of claim 14, wherein the servant drive unit of each servant gate entry support comprises a linkage configured to couple each servant gate entry support to one of the master gate entry support and a servant gate entry support.

16. The system of claim 15, wherein the linkage comprises a hydraulic cylinder and wherein the controller of the master gate entry support is configured to direct one of a master gate entry support or one of the at least two servant gate entry supports coupled to one end of the linkage to be an anchor and to direct one of a master gate entry support or one of the at least two servant gate entry supports coupled to the other end of the linkage to move relative to the anchor by way of activation of the linkage.

17. The system of claim 9, wherein the master gate entry support is autonomous.

18. A system comprising:

a first gate entry support positioned within a tailgate;

a second gate entry support positioned within the tailgate and parallel to the first gate entry support;

a third gate entry support positioned within the tailgate and behind the first gate entry support, the third gate entry support coupled to the first gate entry support by a first linkage;

a fourth gate entry support positioned within the tailgate and behind the second gate entry support, the fourth gate entry support coupled to the second gate entry support by a second linkage;

a pan line positioned in front of a mining face;

a shearer coupled to the pan line and configured to travel across the mining face;

a stage loader coupled to the pan line and configured to receive mined mineral and transport the mined mineral to a transport conveyor;

a plurality of chocks positioned behind the pan line such that the pan line is positioned between the plurality of chocks and the mining face; and wherein the first gate entry support, second gate entry support, third gate entry support, and fourth gate entry support are configured to monitor a condition of the tailgate and advance within the tailgate by way of a drive unit within each of the first gate entry support, second gate entry support, third gate entry support, and fourth gate entry support in response to the condition satisfying an entry condition threshold.

19. The system of claim 18, further comprising a longwall controller and a third linkage configured to couple one of the gate entry supports to the pan line, such that activation of the third linkage moves the pan line closer to the mining face and wherein the longwall controller is configured to control a position for one or more of the gate entry supports such that movement of the pan line relative to a gate entry support coupled to the third linkage steers the pan line relative to the mining face.

20. The system of claim 18, further comprising a fifth gate entry support positioned within a headgate and coupled to the stage loader by way of a first hydraulic cylinder and a sixth gate entry support positioned within the headgate, the sixth gate entry support coupled to the fifth gate entry support by way of a second hydraulic cylinder such that the sixth gate entry support moves within the headgate by activating the second hydraulic cylinder to push against the fifth gate entry support and the fifth gate entry support moves forward by activating the second hydraulic cylinder to pull the fifth gate entry support toward the sixth gate entry support and the stage loader moves toward the fifth gate entry support by the fifth gate entry support activating the first hydraulic cylinder to pull the stage loader toward the fifth gate entry support.

21. An apparatus, comprising:

a sensor configured to gather entry data;

a drive unit configured to advance a gate entry support;

a communication module configured to communicate with a controller;

wherein the controller is coupled to the drive unit and the sensor and the controller is configured to:

receive entry data from the sensor;

determine a condition of a gate entry based on the entry data; and signal the drive unit, by way of the communication module, to move the gate entry support in response to determining that the condition satisfies an entry condition threshold; and wherein the controller determines the condition of the gate entry based on a prior survey of the gate entry.

* * * * *